US008070560B2

(12) United States Patent
Yasuda et al.

(10) Patent No.: US 8,070,560 B2
(45) Date of Patent: Dec. 6, 2011

(54) POLISHING APPARATUS AND METHOD

(75) Inventors: Hozumi Yasuda, Tokyo (JP); Makoto Fukushima, Tokyo (JP); Tetsuji Togawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 563 days.

(21) Appl. No.: 12/292,677

(22) Filed: Nov. 24, 2008

(65) Prior Publication Data

US 2009/0142996 A1 Jun. 4, 2009

(30) Foreign Application Priority Data

Nov. 29, 2007 (JP) ..... 2007-308642

(51) Int. Cl.
*B24B 5/00* (2006.01)

(52) U.S. Cl. ..... 451/289; 451/286; 451/388; 451/398

(58) Field of Classification Search ..... 451/285–289, 451/388, 397, 398, 5
See application file for complete search history.

(56) References Cited

U.S. PATENT DOCUMENTS 6,659,850 B2 * 12/2003 Korovin et al. ..... 451/286
6,857,945 B1 * 2/2005 Chen et al. ..... 451/288
7,025,664 B2 * 4/2006 Korovin et al. ..... 451/289
7,357,699 B2 4/2008 Togawa et al.
7,402,098 B2 * 7/2008 Severson et al. ..... 451/288

FOREIGN PATENT DOCUMENTS

| | | |
|---|---|---|
| JP | 2000-117617 | 4/2000 |
| JP | 2002-343750 | 11/2002 |
| JP | 2003-158105 | 5/2003 |
| JP | 2004-268157 | 9/2004 |
| JP | 2006-128582 | 5/2006 |
| JP | 2006-255851 | 9/2006 |

* cited by examiner

*Primary Examiner* — Dung Van Nguyen
(74) *Attorney, Agent, or Firm* — Wenderoth, Lind & Ponack, L.L.P.

(57) ABSTRACT

A polishing apparatus is used for polishing a substrate such as a semiconductor wafer to a flat mirror finish. The polishing apparatus includes a polishing table having a polishing surface, a polishing head having at least one elastic membrane configured to form a plurality of pressure chambers for being supplied with a pressurized fluid, and a controller configured to control supply of the pressurized fluid to the pressure chambers. The controller controls supply of the pressurized fluid so that the pressurized fluid is supplied first to the pressure chamber located at a central portion of the substrate when the substrate is brought into contact with the polishing surface, and then the pressurized fluid is supplied to the pressure chamber located at a radially outer side of the pressure chamber located at the central portion of the substrate.

7 Claims, 19 Drawing Sheets

POLISHING APPARATUS AND METHOD

BACKGROUND OF THE INVENTION

1. Field of the Invention

The present invention relates to a polishing apparatus and method, and more particularly to a polishing apparatus and method for polishing an object to be polished (substrate) such as a semiconductor wafer to a flat mirror finish.

2. Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring or a polishing head, for holding a substrate such as a semiconductor wafer. When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface, so that the surface of the semiconductor wafer is polished to a flat mirror finish.

In such polishing apparatus, if the relative pressing force applied between the semiconductor wafer, being polished, and the polishing surface of the polishing pad is not uniform over the entire surface of the semiconductor wafer, then the surface of the semiconductor wafer is polished insufficiently or excessively in different regions thereof, which depends on the pressing force applied thereto. It has been customary to uniformize the pressing force applied to the semiconductor wafer by providing a pressure chamber formed by an elastic membrane at the lower portion of the substrate holding device and supplying the pressure chamber with a fluid such as air to press the semiconductor wafer under a fluid pressure through the elastic membrane, as seen in Japanese laid-open patent publication No. 2006-255851.

As described above, in the type of polishing apparatus which has a pressure chamber formed by an elastic membrane at the lower portion of the substrate holding device and supplies a pressurized fluid such as compressed air to the pressure chamber to press the semiconductor wafer under a fluid pressure through the elastic membrane, the following drawbacks have been discovered.

Specifically, after the semiconductor wafer is brought into contact with the polishing surface of the polishing pad, the semiconductor wafer is pressed against the polishing surface under the fluid pressure through the elastic membrane by supplying the pressurized fluid such as compressed air to the pressure chamber, thereby starting polishing of the semiconductor wafer. However, immediately after starting polishing of the semiconductor wafer, in some cases, there occurs a phenomenon that the semiconductor wafer is cracked or damaged.

The inventors of the present application have conducted various experiments and analyzed the experimental results for the purpose of finding out why the semiconductor wafer is cracked or damaged at the time of starting polishing of the semiconductor wafer. As a result, it has been discovered that some damage of the semiconductor wafer is caused by surface condition of the polishing pad. More specifically, it has been customary to form specific grooves or holes in the surface of the polishing pad. For example, there are a type of polishing pad which has a number of small holes having a diameter of 1 to 2 mm in the surface thereof to improve retention capacity of a slurry (polishing liquid), a type of polishing pad which has grooves in a lattice pattern, concentric pattern or spiral pattern in the surface thereof to improve fluidity of a slurry (polishing liquid), to improve flatness and uniformity of a surface of a wafer and to prevent a wafer from sticking to the surface of the polishing pad, and other types of polishing pads. In this case, in the type of polishing pad having no grooves, such as a polishing pad having small holes, in the surface thereof, or the type of polishing pad which does not have a sufficient number of grooves or sufficient depths of grooves in the surface thereof, it has been discovered that the semiconductor wafer is often cracked or damaged at the time of starting polishing of the semiconductor wafer after the semiconductor wafer is brought into contact with the surface (polishing surface) of the polishing pad.

The inventors of the present application have discovered from analysis of the experimental results that if the polishing pad has no grooves or does not have a sufficient number of grooves or sufficient depths of grooves in the surface thereof, then air or slurry is trapped between the polishing surface and the semiconductor wafer when the semiconductor wafer is brought into contact with the polishing surface, and thus the semiconductor wafer is likely to cause larger deformation than normal when polishing pressure is applied to the semiconductor wafer as it is, resulting in cracking or damage of the semiconductor wafer.

Further, as described above, in the type of polishing apparatus which has a pressure chamber formed by an elastic membrane at the lower portion of the substrate holding device and supplies a pressurized fluid such as compressed air to the pressure chamber to press the semiconductor wafer under a fluid pressure through the elastic membrane, there is a polishing apparatus which has a plurality of pressure chambers and can press a semiconductor wafer against a polishing surface under different pressures at respective areas in a radial direction of the semiconductor wafer by adjusting pressures of the pressurized fluid to be supplied to the respective pressure chambers. In this type of polishing apparatus, although the polishing rate within the surface of the semiconductor wafer can be controlled at the respective areas of the semiconductor wafer, because the holding and pressing surface of the polishing head for holding and pressing the semiconductor wafer comprises a flexible elastic membrane such as rubber, if there is a pressure difference in pressures of the pressurized fluid supplied to two adjacent areas, then there occurs a step-like difference in polishing pressures in the two adjacent areas. As a result, a step-like height difference in polishing configuration (polishing profile) is produced. In this case, if there is a large pressure difference in pressures of the pressurized fluid supplied to the two adjacent areas, the step-like height difference in polishing configuration (polishing profile) becomes larger depending on the pressure difference in pressures of the pressurized fluid supplied to the two adjacent areas.

SUMMARY OF THE INVENTION

The present invention has been made in view of the above discoveries which inventors found. It is therefore a first object of the present invention to provide a polishing apparatus and method which can prevent air or slurry (polishing liquid) from being trapped between a polishing surface and a substrate such as a semiconductor wafer when the substrate is brought into contact with the polishing surface and can suppress excessive deformation of the substrate when polishing pressure is applied to the substrate, even if the polishing surface has no grooves or does not have a sufficient number of grooves or sufficient depths of grooves.

Further, a second object of the present invention is to provide a polishing apparatus having a polishing head which can press a substrate against a polishing surface under different pressures at respective areas of the substrate and can exert a polishing pressure having a mild shift without a step-like difference in polishing pressures in adjacent areas of the substrate when the substrate is pressed against the polishing surface under different pressures at the adjacent areas of the substrate.

In order to achieve the above object, according to a first aspect of the present invention, there is provided an apparatus for polishing a substrate, comprising: a polishing table having a polishing surface; a polishing head having at least one elastic membrane configured to form a plurality of pressure chambers for being supplied with a pressurized fluid, the elastic membrane being configured to press the substrate against the polishing surface under a fluid pressure when the pressure chambers are supplied with the pressurized fluid; and a controller configured to control supply of the pressurized fluid to the pressure chambers; wherein the controller controls supply of the pressurized fluid so that the pressurized fluid is supplied first to the pressure chamber located at a central portion of the substrate when the substrate is brought into contact with the polishing surface, and then the pressurized fluid is supplied to the pressure chamber located at a radially outer side of the pressure chamber located at the central portion of the substrate.

According to one aspect of the present invention, the pressurized fluid is supplied first to the pressure chamber located at the central portion of the substrate, and the central portion of the substrate is brought into contact with the polishing surface. Then, after a lapse of short time, the pressurized fluid is supplied to the pressure chamber located at a radially outer side of the pressure chamber located at the central portion of the substrate, and the outer circumferential portion of the substrate is pressed against the polishing surface. In this manner, by bringing the central portion of the substrate into contact with the polishing surface first, air or slurry is not trapped between the polishing surface and the substrate, and hence the substrate is not likely to cause larger deformation than normal, even if polishing pressure is applied as it is. Accordingly, cracking or damage of the substrate caused by larger deformation than normal at the time of starting polishing of the substrate after the substrate is brought into contact with the polishing surface can be prevented.

In a preferred aspect of the present invention, the controller controls the polishing head to lower the polishing head to a preset polishing position, the preset polishing position being defined as a position where a gap is formed between a lower surface of the substrate held by the polishing head and the polishing surface before the polishing chamber located at the central portion of the substrate is supplied with the pressurized fluid.

In a preferred aspect of the present invention, the polishing head comprises a top ring body to which the elastic membrane is attached, and a retainer ring provided at a peripheral portion of the top ring body; and wherein when the polishing head is lowered to the preset polishing position, the retainer ring is brought into contact with the polishing surface.

According to a second aspect of the present invention, there is provided an apparatus for polishing a substrate, comprising: a polishing table having a polishing surface; a polishing head having at least one elastic membrane configured to form a pressure chamber for being supplied with a pressurized fluid, the elastic membrane being configured to press the substrate against the polishing surface under a fluid pressure when the pressure chamber is supplied with the pressurized fluid; and a controller configured to control supply of the pressurized fluid to the pressure chamber; wherein the controller controls supply of the pressurized fluid so that the pressurized fluid is supplied first from a supply hole located at a position corresponding to a central portion of the substrate to the pressure chamber when the substrate is brought into contact with the polishing surface, and then the pressurized fluid is supplied from a supply hole located at a radially outer side of the supply hole located at the position corresponding to the central portion of the substrate to the pressure chamber.

According to one aspect of the present invention, the pressurized fluid is supplied first from the supply hole located at the position corresponding to the central portion of the substrate, and the central portion of the substrate is brought into contact with the polishing surface and is pressed against the polishing surface. Then, after a lapse of short time, the pressurized fluid is supplied from the supply hole located at the position corresponding to the outer circumferential portion of the substrate to the outer circumferential portion of the pressure chamber, and the outer circumferential portion of the substrate is pressed against the polishing surface. In this manner, by bringing the central portion of the substrate into contact with the polishing surface first, air or slurry is not trapped between the polishing surface and the substrate, and hence the substrate is not likely to cause larger deformation than normal, even if polishing pressure is applied as it is. Accordingly, cracking or damage of the substrate caused by larger deformation than normal at the time of starting polishing of the substrate after the substrate is brought into contact with the polishing surface can be prevented.

In a preferred aspect of the present invention, the controller controls the polishing head to lower the polishing head to a preset polishing position, the preset polishing position being defined as a position where a gap is formed between a lower surface of the substrate held by the polishing head and the polishing surface before the polishing chamber is supplied with the pressurized fluid.

According to one aspect of the present invention, before the pressurized fluid is supplied to the pressure chamber and the elastic membrane is inflated, the substrate is not brought into contact with the polishing surface, and a small clearance is formed between the polishing surface and the substrate.

In a preferred aspect of the present invention, the polishing head comprises a top ring body to which the elastic membrane is attached, and a retainer ring provided at a peripheral portion of the top ring body; and wherein when the polishing head is lowered to the preset polishing position, the retainer ring is brought into contact with the polishing surface.

According to a third aspect of the present invention, there is provided a method of polishing a substrate, comprising: holding a substrate by a polishing head and bringing the substrate into contact with a polishing surface of a polishing table by the polishing head, the polishing head having a plurality of pressure chambers formed by an elastic membrane; and pressing the substrate against the polishing surface to polish the substrate by supplying a pressurized fluid to the pressure chambers; wherein the pressurized fluid is supplied first to the pressure chamber located at a central portion of the substrate when the substrate is brought into contact with the polishing surface, and then the pressurized fluid is supplied to the pressure chamber located at a radially outer side of the pressure chamber located at the central portion of the substrate.

According to one aspect of the present invention, the pressurized fluid is supplied first to the pressure chamber located at the central portion of the substrate, and the central portion of the substrate is brought into contact with the polishing surface and is pressed against the polishing surface. Then, after a lapse of short time, the pressurized fluid is supplied to the pressure chamber located at a radially outer side of the pressure chamber located at the central portion of the substrate, and the outer circumferential portion of the substrate is pressed against the polishing surface. In this manner, by bringing the central portion of the substrate into contact with the polishing surface first, air or slurry is not trapped between the polishing surface and the substrate, and hence the substrate is not likely to cause larger deformation than normal, even if polishing pressure is applied as it is. Accordingly, cracking or damage of the substrate caused by larger deformation than normal at the time of starting polishing of the substrate after the substrate is brought into contact with the polishing surface can be prevented.

In a preferred aspect of the present invention, the method further comprises lowering the polishing head to a preset polishing position, the preset polishing position being defined as a position where a gap is formed between a lower surface of the substrate held by the polishing head and the polishing surface before the polishing chamber located at the central portion of the substrate is supplied with the pressurized fluid.

In a preferred aspect of the present invention, the polishing head comprises a top ring body to which the elastic membrane is attached, and a retainer ring provided at a peripheral portion of the top ring body; and wherein when the polishing head is lowered to the preset polishing position, the retainer ring is brought into contact with the polishing surface.

According to a fourth aspect of the present invention, there is provided a method of polishing a substrate, comprising: holding a substrate by a polishing head and bringing the substrate into contact with a polishing surface of a polishing table by the polishing head, the polishing head having a pressure chamber formed by an elastic membrane; and pressing the substrate against the polishing surface to polish the substrate by supplying a pressurized fluid from a plurality of supply holes provided at positions corresponding to different radial positions of the substrate to the pressure chamber; wherein the pressurized fluid is supplied first from the supply hole located at the position corresponding to a central portion of the substrate to the pressure chamber when the substrate is brought into contact with the polishing surface, and then the pressurized fluid is supplied from the supply hole located at a radially outer side of the supply hole located at the position corresponding to the central portion of the substrate to the pressure chamber.

According to one aspect of the present invention, the pressurized fluid is supplied first from the supply hole located at the position corresponding to the central portion of the substrate, and the central portion of the substrate is brought into contact with the polishing surface and is pressed against the polishing surface. Then, after a lapse of short time, the pressurized fluid is supplied from the supply hole located at the position corresponding to the outer circumferential portion of the substrate to the outer circumferential portion of the pressure chamber, and the outer circumferential portion of the substrate is pressed against the polishing surface. In this manner, by bringing the central portion of the substrate into contact with the polishing surface first, air or slurry is not trapped between the polishing surface and the substrate, and hence the substrate is not likely to cause larger deformation than normal, even if polishing pressure is applied as it is. Accordingly, cracking or damage of the substrate caused by larger deformation than normal at the time of starting polishing of the substrate after the substrate is brought into contact with the polishing surface can be prevented.

In a preferred aspect of the present invention, the method further comprises lowering the polishing head to a preset polishing position, the preset polishing position being defined as a position where a gap is formed between a lower surface of the substrate held by the polishing head and the polishing surface before the polishing chamber is supplied with the pressurized fluid.

In a preferred aspect of the present invention, the polishing head comprises a top ring body to which the elastic membrane is attached, and a retainer ring provided at a peripheral portion of the top ring body; and wherein when the polishing head is lowered to the preset polishing position, the retainer ring is brought into contact with the polishing surface.

According to a fifth aspect of the present invention, there is provided an apparatus for polishing a substrate, comprising: a polishing table having a polishing surface; a polishing head having at least one elastic membrane configured to form a plurality of pressure chambers for being supplied with a pressurized fluid, the elastic membrane being configured to press the substrate against the polishing surface under a fluid pressure when the pressure chambers are supplied with the pressurized fluid; and a diaphragm configured to cover at least part of the elastic membrane and extend over the two adjacent pressure chambers, the diaphragm being composed of a material having higher rigidity than the elastic membrane; wherein the diaphragm has an area of not less than 10 mm from a boundary between the two pressure chambers both to an inner circumferential side and to an outer circumferential side of the elastic membrane.

According to one aspect of the present invention, when there is a pressure difference between pressures in the two adjacent chambers, the polishing pressure, and hence the polishing rate at the boundary between the two adjacent areas is lowered gradually from one room side (higher pressure room side) to the other room side (lower pressure room side). Specifically, by providing the diaphragm, the gradient of the polishing pressure (polishing rate) can be gentle at the boundary between the two adjacent areas.

Normally, since the elastic membrane used for defining the pressure chamber has low rigidity (modulus of longitudinal elasticity/young modulus is small and thickness is small), if there is a relatively large pressure difference in the adjacent areas, then a step-like difference (sharp change) in distribution of polishing pressure occurs at the boundary between the adjacent areas and its neighborhood.

In contrast, according to the present invention, since the diaphragm composed of a material having higher rigidity than the elastic membrane (hard to be deformed elastically, large modulus of longitudinal elasticity) is used, the deformation quantity of the diaphragm at local areas caused by the pressure difference becomes small. Therefore, the area which undergoes deformation is expanded, and the gradient of the polishing pressure can be gentle at the boundary between the adjacent areas. Thus, the material required for the diaphragm comprises an elastic material, and has larger modulus of longitudinal elasticity than the elastic membrane and is hard to be deformed.

In a preferred aspect of the present invention, the diaphragm is fixed to the elastic membrane.

In a preferred aspect of the present invention, the diaphragm is composed of one of resin comprising polyether ether ketone (PEEK), polyphenylene sulfide (PPS) or polyimide, metal comprising stainless steel or aluminium, and ceramics comprising alumina, zirconia, silicon carbide or silicon nitride.

The material of the diaphragm may be general engineering plastics such as polyethylene terephthalate (PET), polyoxymethylene (POM) or polycarbonate, other than the above materials.

In a preferred aspect of the present invention, the elastic membrane is composed of ethylene propylene rubber (EPDM), polyurethane rubber, or silicone rubber.

In a preferred aspect of the present invention, the diaphragm is configured to cover a substantially entire surface of the elastic membrane.

According to the present invention, when there is a pressure difference between pressures in the two adjacent chambers, the polishing pressure, and hence the polishing rate at the boundary between the two adjacent areas is lowered gradually from one room side (higher pressure room side) to the other room side (lower pressure room side). Specifically, by providing the diaphragm, the gradient of the polishing pressure (polishing rate) can be gentle at the boundary between the two adjacent areas.

In a preferred aspect of the present invention, the apparatus further comprises a second elastic membrane configured to cover the diaphragm, the second elastic membrane constituting a substrate holding surface configured to contact the substrate and hold the substrate.

According to the present invention, the diaphragm is covered with the elastic membrane so that the diaphragm is not brought into contact with the substrate directly. Because the elastic membrane constitutes a holding surface for holding the substrate, the elastic membrane is made of a highly strong and durable rubber material such as ethylene propylene rubber (EPDM), polyurethane rubber, silicone rubber, or the like.

In a preferred aspect of the present invention, the second elastic membrane extends over the diaphragm and the elastic membrane configured to form the pressure chambers.

According to a sixth aspect of the present invention, there is provided an apparatus for polishing a substrate, comprising: a table having a polishing surface thereon; a head for holding and pressing the substrate against the polishing surface, the head having at least one membrane for forming a plurality of cavities, to which a pressurized fluid can be supplied respectively, so as to press the substrate against the polishing surface; a device for adjusting a pressure of the pressurized fluid; and a device for controlling the device for adjusting the pressure of the pressurized fluid, thereby controlling a supply of the pressurized fluid to the plurality of cavities respectively; wherein the device for controlling the device for adjusting the pressure of the pressurized fluid is operable so as to prevent the device for adjusting the pressure of the pressurized fluid from supplying the pressurized fluid to at least one cavity located near the edge of the membrane, while the substrate is in a first contact with the polishing surface.

According to one aspect of the present invention, when the pressurized fluid is supplied first to the cavity (i.e. pressure chamber) located at the central portion of the substrate, and the central portion of the substrate is brought into contact with the polishing surface, the pressurized fluid is not supplied to the cavity (i.e. pressure chamber) located at the edge of the membrane, and thus the outer circumferential portion of the substrate is prevented from being brought into contact with the polishing surface.

According to the present invention, even if the polishing surface has no grooves or does not have a sufficient number of grooves or sufficient depths of grooves, when the substrate such as a semiconductor wafer is brought into contact with the polishing surface, air or slurry is not trapped between the polishing surface and the substrate, and the substrate can be prevented from being deformed excessively when polishing pressure is applied to the substrate. Accordingly, cracking or damage of the substrate caused by larger deformation than normal at the time of starting polishing of the substrate can be prevented.

Further, according to the present invention, in the polishing head which can press the substrate against the polishing surface under different pressures at respective areas of the substrate, when the substrate is pressed against the polishing surface under different pressures at the adjacent areas, the polishing pressure, and hence the polishing rate can be shifted gently without a step-like difference in polishing pressures at the adjacent areas of the substrate. Accordingly, optimum polishing configuration (polishing profile) can be obtained.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
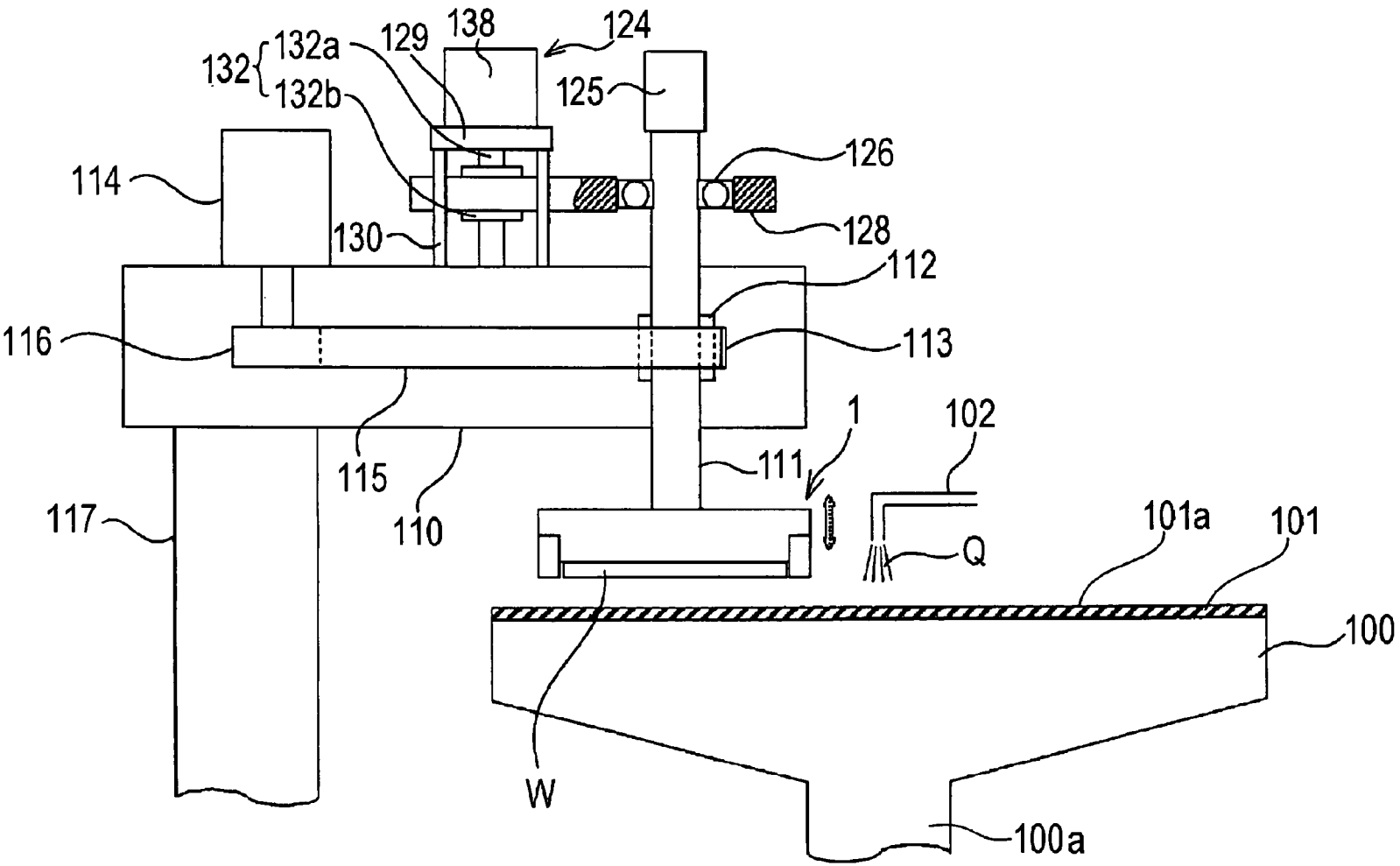
FIG. 1 is a schematic view showing an entire structure of a polishing apparatus according to an embodiment of the present invention.

A polishing apparatus according to embodiments of the present invention will be described below with reference to FIGS. 1 through 19. Like or corresponding parts are denoted by like or corresponding reference numerals throughout drawings and will not be described below repetitively.

FIG. 1 is a schematic view showing an entire structure of a polishing apparatus according to an embodiment of the present invention. As shown in FIG. 1, the polishing apparatus comprises a polishing table 100, and a top ring 1 constituting a polishing head for holding a substrate such as a semiconductor wafer as an object to be polished and pressing the substrate against a polishing surface on the polishing table 100.

The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface to polish a semiconductor wafer W. A polishing liquid supply nozzle 102 is provided above the polishing table 100 to supply a polishing liquid Q onto the polishing pad 101 on the polishing table 100.

The top ring 1 is connected to a lower end of a top ring shaft 111, which is vertically movable with respect to a top ring head 110 by a vertically moving mechanism 124. When the vertically moving mechanism 124 moves the top ring shaft 111 vertically, the top ring 1 is lifted and lowered as a whole for positioning with respect to the top ring head 110. A rotary joint 125 is mounted on the upper end of the top ring shaft 111.

The vertically moving mechanism 124 for vertically moving the top ring shaft 111 and the top ring 1 comprises a bridge 128 on which the top ring shaft 111 is rotatably supported by a bearing 126, a ball screw 132 mounted on the bridge 128, a support base 129 supported by support posts 130, and an AC servomotor 138 mounted on the support base 129. The support base 129, which supports the AC servomotor 138 thereon, is fixedly mounted on the top ring head 110 by the support posts 130.

The ball screw 132 comprises a screw shaft 132*a* coupled to the AC servomotor 138 and a nut 132*b* threaded over the screw shaft 132*a*. The top ring shaft 111 is vertically movable in unison with the bridge 128 by the vertically moving mechanism 124. When the AC servomotor 138 is energized, the bridge 128 moves vertically via the ball screw 132, and the top ring shaft 111 and the top ring 1 move vertically.

The top ring shaft 111 is connected to a rotary sleeve 112 by a key (not shown). The rotary sleeve 112 has a timing pulley 113 fixedly disposed therearound. A top ring motor 114 having a drive shaft is fixed to the top ring head 110. The timing pulley 113 is operatively coupled to a timing pulley 116 mounted on the drive shaft of the top ring motor 114 by a timing belt 115. When the top ring motor 114 is energized, the timing pulley 116, the timing belt 115, and the timing pulley 113 are rotated to rotate the rotary sleeve 112 and the top ring shaft 111 in unison with each other, thus rotating the top ring 1. The top ring head 110 is supported on a top ring head shaft 117 fixedly supported on a frame (not shown).

In the polishing apparatus constructed as shown in FIG. 1, the top ring 1 is configured to hold the substrate such as a semiconductor wafer W on its lower surface. The top ring head 110 is pivotable (swingable) about the top ring head shaft 117. Thus, the top ring 1, which holds the semiconductor wafer W on its lower surface, is moved between a position at which the top ring 1 receives the semiconductor wafer W and a position above the polishing table 100 by pivotal movement of the top ring head 110. The top ring 1 is lowered to press the semiconductor wafer W against a surface (polishing surface) 101*a* of the polishing pad 101. At this time, while the top ring 1 and the polishing table 100 are respectively rotated, a polishing liquid is supplied onto the polishing pad 101 by the polishing liquid supply nozzle 102 provided above the polishing table 100. The semiconductor wafer W is brought into sliding contact with the polishing surface 101*a* of the polishing pad 101. Thus, a surface of the semiconductor wafer W is polished.

Figure 2:
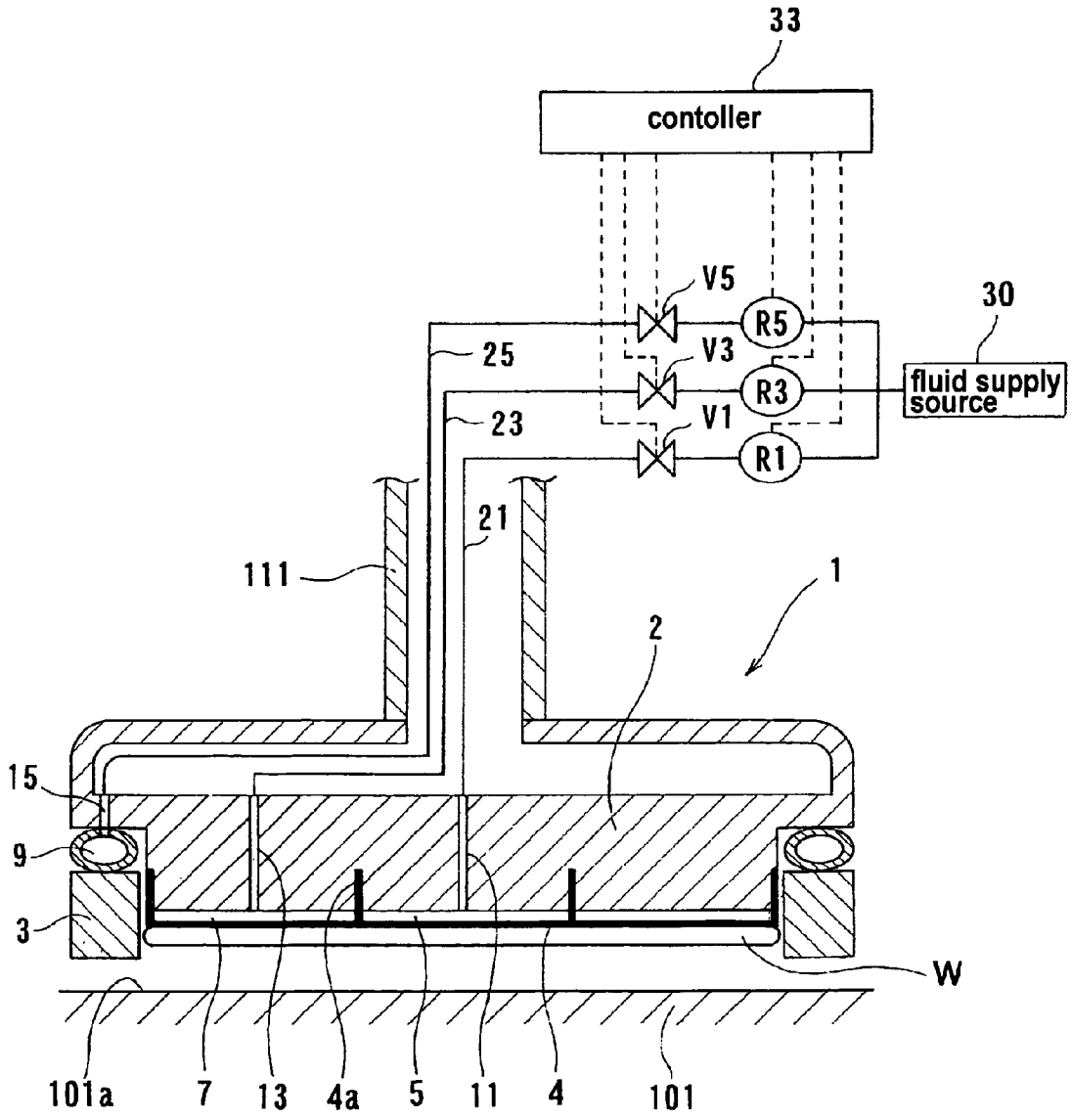
FIG. 2 is a schematic cross-sectional view showing a top ring constituting a polishing head for holding a semiconductor wafer as an object to be polished and pressing the semiconductor wafer against a polishing surface on a polishing table according to a first aspect of the present invention.

Next, a polishing head of a polishing apparatus according to a first aspect of the present invention will be described below with reference to FIG. 2. FIG. 2 is a schematic cross-sectional view showing a top ring 1 constituting a polishing head for holding a semiconductor wafer W as an object to be polished and pressing the semiconductor wafer W against a polishing surface on a polishing table. FIG. 2 shows only main structural elements constituting the top ring 1.

As shown in FIG. 2, the top ring 1 basically comprises a top ring body 2 for pressing a semiconductor wafer W against the polishing surface 101*a*, and a retainer ring 3 for directly pressing the polishing surface 101*a*. The top ring body 2 is in the form of a circular plate, and the retainer ring 3 is attached to a peripheral portion of the top ring body 2. The top ring body 2 is made of resin such as engineering plastics (e.g., PEEK). As shown in FIG. 2, the top ring 1 has an elastic membrane 4 attached to a lower surface of the top ring body 2. The elastic membrane 4 is brought into contact with a rear face of a semiconductor wafer held by the top ring 1. The elastic membrane 4 is made of a highly strong and durable rubber material such as ethylene propylene rubber (EPDM), polyurethane rubber, silicone rubber, or the like.

The elastic membrane 4 has a circular partition wall 4*a*, and a circular central chamber 5 and an annular outer chamber 7 are formed by the partition wall 4*a* between the upper surface of the elastic membrane 4 and the lower surface of the top ring body 2. A passage 11 communicating with the central chamber 5 and a passage 13 communicating with the outer chamber 7 are formed in the top ring body 2. The passage 11 is connected via a passage 21 comprising a tube, a connector and the like to a fluid supply source 30. The passage 13 is connected via a passage 23 comprising a tube, a connector and the like to the fluid supply source 30. An opening and closing valve V1 and a pressure regulator R1 are provided in the passage 21, and an opening and closing valve V3 and a pressure regulator R3 are provided in the passage 23. The fluid supply source 30 serves to supply a pressurized fluid such as compressed air.

Further, a retainer chamber 9 is formed immediately above the retainer ring 3, and the retainer chamber 9 is connected via a passage 15 formed in the top ring body 2 and a passage 25 comprising a tube, a connector and the like to the fluid supply source 30. An opening and closing valve V5 and a pressure regulator R5 are provided in the passage 25. The pressure regulators R1, R3 and R5 have a pressure adjusting function for adjusting pressures of the pressurized fluid supplied from the fluid supply source 30 to the central chamber 5, the outer chamber 7 and the retainer chamber 9. The pressure regulators R1, R3 and R5 and the opening and closing valves V1, V3 and V5 are connected to a controller 33, and operation of the pressure regulators R1, R3 and R5 and the opening and closing valves V1, V3 and V5 is controlled by the controller 33.

In the top ring 1 constructed as shown in FIG. 2, pressure chambers, i.e. the central chamber 5 and the outer chamber 7 are formed between the elastic membrane 4 and the top ring body 2, and a pressure chamber, i.e. the retainer chamber 9 is formed immediately above the retainer ring 3. The pressures of the fluid supplied to the central chamber 5, the outer chamber 7 and the retainer chamber 9 can be independently controlled by the pressure regulators R1, R3 and R5.

With this arrangement, pressing forces for pressing the semiconductor wafer W against the polishing pad 101 can be adjusted at respective local areas of the semiconductor wafer by adjusting pressures of the fluid to be supplied to the respective pressure chambers, and a pressing force for pressing the retainer ring 3 against the polishing pad 101 can be adjusted by adjusting pressure of the fluid to be supplied to the pressure chamber.

Specifically, pressing forces for pressing the semiconductor wafer against the polishing pad 101 can be independently adjusted at a circular area of the semiconductor wafer immediately below the central chamber 5 and an annular area (ring area) of the semiconductor wafer immediately below the outer chamber 7, and a pressing force for pressing the retainer ring 3 against the polishing pad 101 can be independently adjusted.

Next, a polishing process of the semiconductor wafer by the top ring 1 constructed as shown in FIG. 2 will be described below with reference to FIG. 3. FIG. 3 schematically shows only main structural elements of the top ring 1.

Figure 3A:
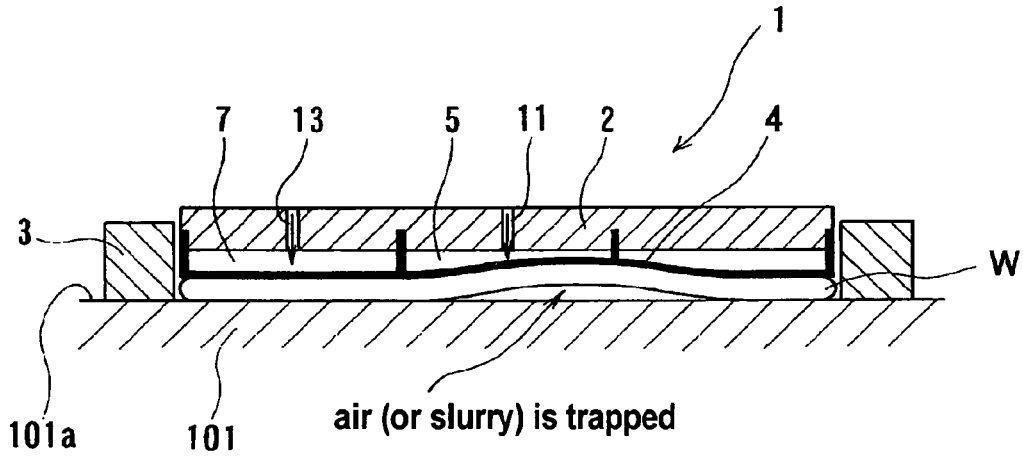
FIGS. 3A and 3B are schematic cross-sectional views showing the manner in which the semiconductor wafer is polished by the top ring constructed as shown in FIG. 2.

The top ring 1 receives a semiconductor wafer W from a substrate transfer device and holds the semiconductor wafer W under vacuum. Although not shown in FIGS. 2 and 3, the elastic membrane 4 has a plurality of holes for holding the semiconductor wafer W under vacuum, and these holes are connected to a vacuum source such as a vacuum pump. The top ring 1 which holds the semiconductor wafer W under vacuum is lowered to a preset polishing position of the top ring which has been preset. At the preset polishing position, the retainer ring 3 is brought into contact with the surface (polishing surface) 101*a* of the polishing pad 101. However, before the semiconductor wafer W is polished, since the semiconductor wafer W is attracted to and held by the top ring 1, there is a small gap of about 1 mm, for example, between the lower surface (surface to be polished) of the semiconductor wafer W and the polishing surface 101*a* of the polishing pad 101. At this time, the polishing table 100 and the top ring 1 are being rotated about their own axes. In this state, the opening and closing valve V1 and the opening and closing valve V3 are simultaneously opened, and a pressurized fluid is supplied from the fluid supply source 30 to the central chamber 5 and the outer chamber 7. Thus, the elastic membrane 4 located at the upper surface (rear surface) of the semiconductor wafer W is inflated to bring the lower surface of the semiconductor wafer W into contact with the polishing surface 101*a* of the polishing pad 101. At this time, if the polishing pad 101 has no grooves or does not have a sufficient number of grooves or sufficient depths of grooves in the surface thereof, then air or slurry is trapped between the polishing surface 101*a* of the polishing pad 101 and the semiconductor wafer W as shown in FIG. 3A, and thus the semiconductor wafer W is likely to cause larger deformation than normal when polishing pressure is applied to the semiconductor wafer W as it is. As a result, the semiconductor wafer W is cracked or damaged.

Figure 3B:
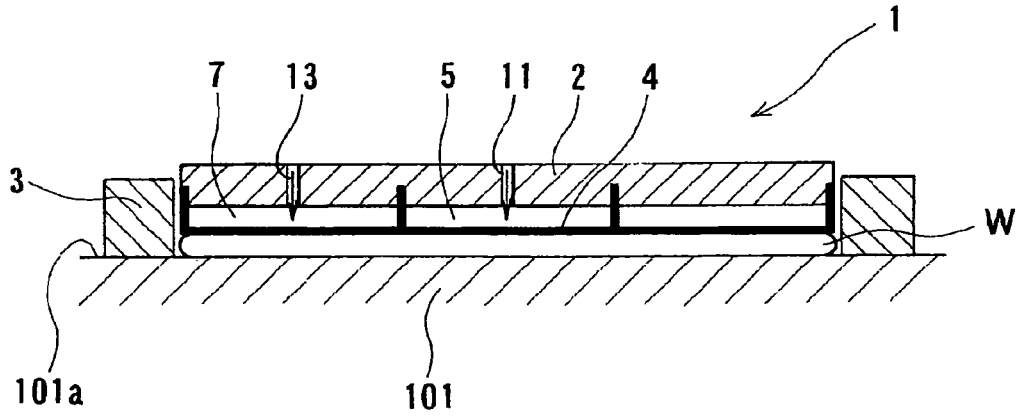

In contrast, when the top ring 1 which holds the semiconductor wafer W under vacuum is lowered to the preset polishing position of the top ring, and then the elastic membrane 4 is inflated, the controller 33 opens the opening and closing valve V1, and supplies a pressurized fluid from the fluid supply source 30 to the central chamber 5 to inflate only a central portion of the elastic membrane 4. Thus, the central portion of the lower surface of the semiconductor wafer W is brought into contact with the polishing surface 101*a* of the polishing pad 101 and is pressed against the polishing surface 101*a* of the polishing pad 101. Then, after a lapse of short time, for example, within 1 to 3 seconds after the controller 33 opens the opening and closing valve V1, the controller 33 opens the opening and closing valve V3, and supplies the pressurized fluid from the fluid supply source 30 to the outer chamber 7 to inflate the outer circumferential portion of the elastic membrane 4. Thus, the outer circumferential portion of the lower surface of the semiconductor wafer W is pressed against the polishing surface 101*a* of the polishing pad 101. In this manner, by bringing the central portion of the semiconductor wafer W into contact with the polishing surface first and pressing the central portion of the semiconductor wafer W against the polishing surface, as shown in FIG. 3B, air or slurry is not trapped between the polishing surface 101*a* of the polishing pad 101 and the semiconductor wafer W, and hence the semiconductor wafer W is not likely to cause larger deformation than normal, even if polishing pressure is applied as it is. Accordingly, cracking or damage of the semiconductor wafer W caused by larger deformation than normal at the time of starting polishing of the semiconductor wafer after the semiconductor wafer W is brought into contact with the polishing surface 101*a* can be prevented substantially.

Figure 4:
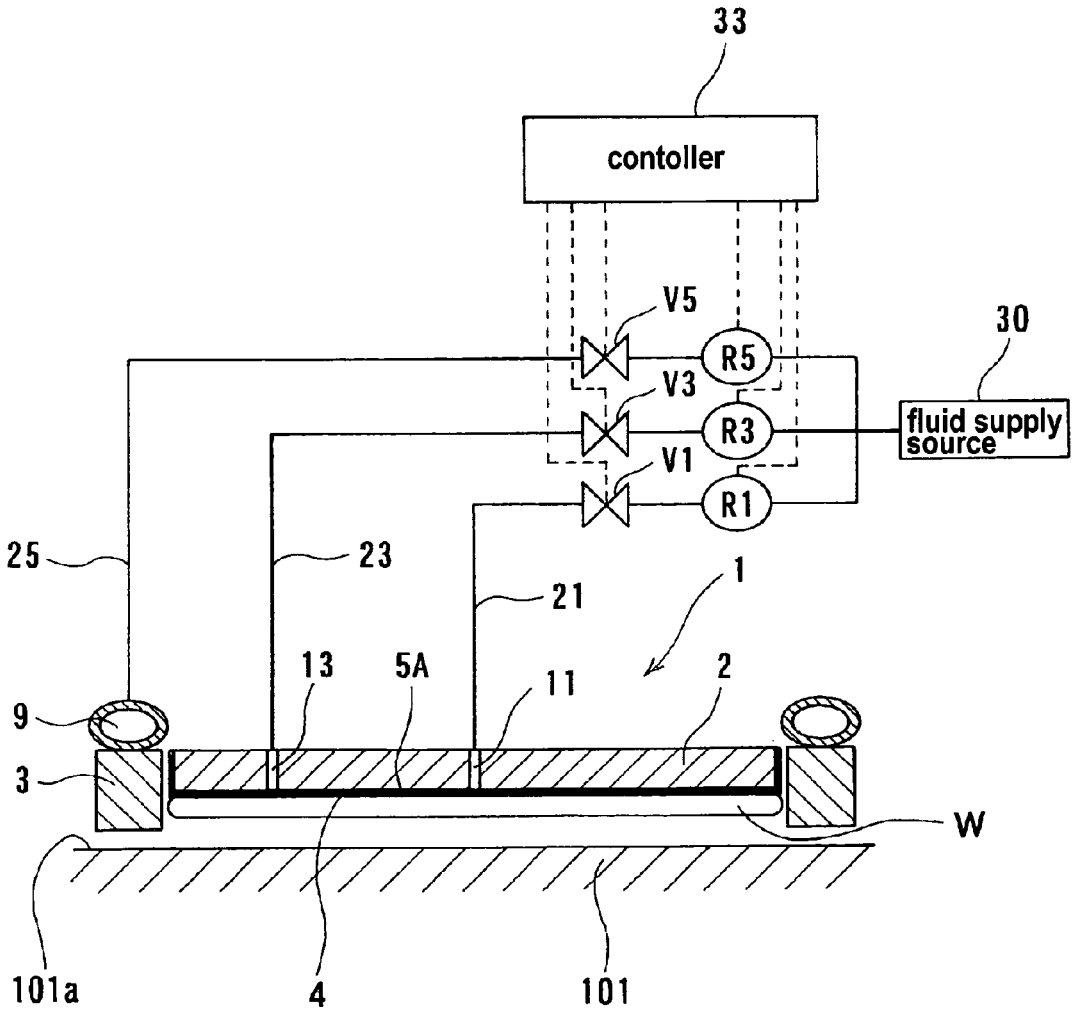
FIG. 4 is a schematic cross-sectional view showing a modified embodiment of a top ring constituting a polishing head for holding a semiconductor wafer as an object to be polished and pressing the semiconductor wafer against a polishing surface on a polishing table.

FIG. 4 is a schematic cross-sectional view showing a modified embodiment of a top ring 1 constituting a polishing head for holding a semiconductor wafer W as an object to be polished and pressing the semiconductor wafer W against a polishing surface on a polishing table. FIG. 4 schematically shows only main structural elements of the top ring 1.

In the embodiment shown in FIG. 4, a single pressure chamber 5A is formed between the upper surface of the elastic membrane 4 and the lower surface of the top ring body 2. A passage (supply hole) 11 formed at the central portion of the top ring body 2 is connected via a passage 21 to a fluid supply source 30, and a passage (supply hole) 13 formed at the outer circumferential portion of the top ring body 2 is connected via a passage 23 to the fluid supply source 30. An opening and closing valve V1 and a pressure regulator R1 are provided in the passage 21, and an opening and closing valve V3 and a pressure regulator R3 are provided in the passage 23. The retainer chamber 9 is formed immediately above the retainer ring 3, and the retainer chamber 9 is connected via a passage 25 to the fluid supply source 30. An opening and closing valve V5 and a pressure regulator R5 are provided in the passage 25. The pressure regulators R1, R3 and R5 and the opening and closing valves V1, V3 and V5 are connected to a controller 33, and operation of the pressure regulators R1, R3 and R5 and the opening and closing valves V1, V3 and V5 is controlled by the controller 33.

Figure 5A:
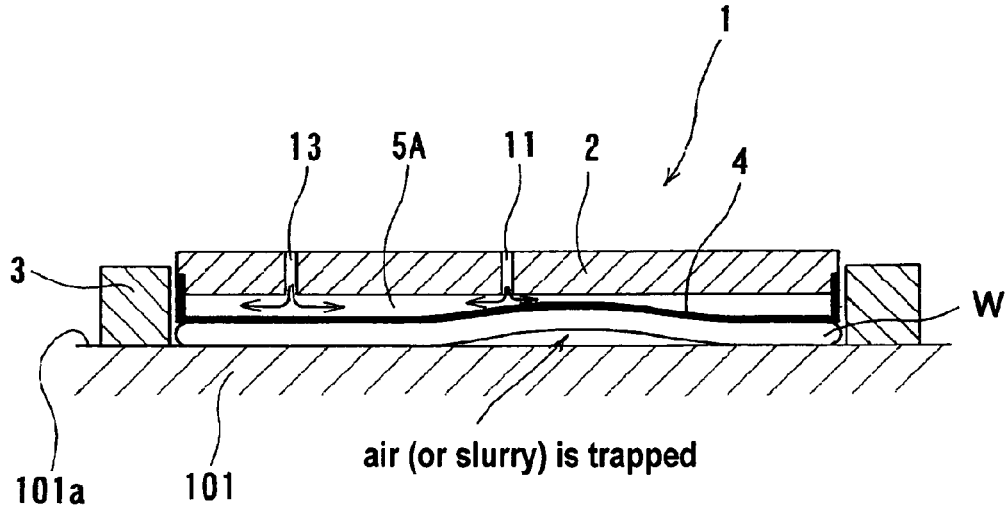
FIGS. 5A and 5B are schematic cross-sectional views showing the manner in which the semiconductor wafer is polished by the top ring constructed as shown in FIG. 4.
Figure 5B:
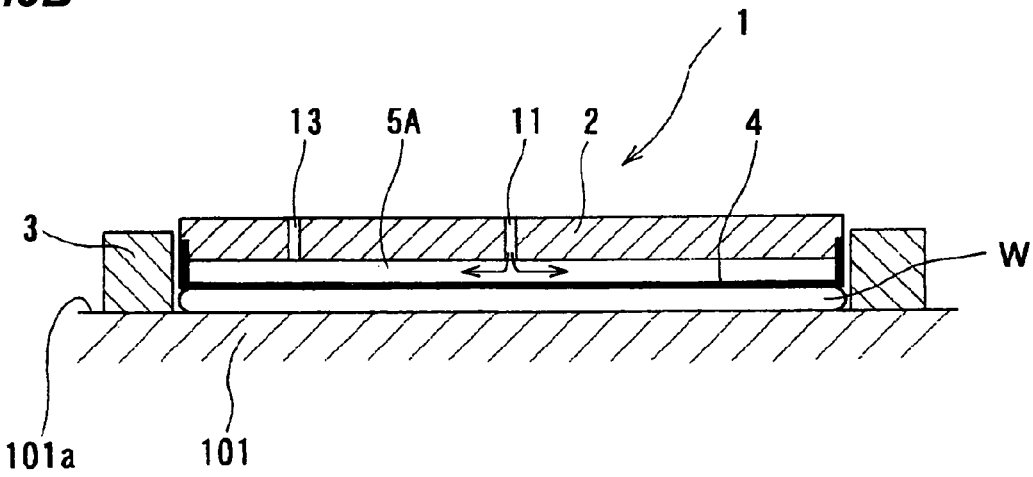

FIGS. 5A and 5B are schematic cross-sectional views showing the manner in which the semiconductor wafer W is polished by the top ring 1 constructed as shown in FIG. 4.

The top ring 1 which holds the semiconductor wafer W under vacuum is lowered to the preset polishing position of the top ring, and then the opening and closing valve V1 and the opening and closing valve V3 are simultaneously opened. A pressurized fluid is supplied from the passage (supply hole) 11 and the passage (supply hole) 13 to the central portion and the outer circumferential portion of the pressure chamber 5A simultaneously. Thus, the elastic membrane 4 located at the upper surface (rear surface) of the semiconductor wafer W is inflated to press the lower surface of the semiconductor wafer W against the polishing surface 101*a* of the polishing pad 101. At this time, if the polishing pad 101 has no grooves or does not have a sufficient number of grooves or sufficient depths of grooves in the surface thereof, as shown in FIG. 5A, air or slurry is trapped between the polishing surface 101*a* of the polishing pad 101 and the semiconductor wafer W, and hence the semiconductor wafer W is likely to cause larger deformation than normal when polishing pressure is applied to the semiconductor wafer W as it is. As a result, the semiconductor wafer W is cracked or damaged.

In contrast, when the top ring 1 which holds the semiconductor wafer W under vacuum is lowered to the preset polishing position of the top ring, and then the elastic membrane 4 is inflated, the controller 33 opens the opening and closing valve V1, and supplies a pressurized fluid from the passage (supply hole) 11 to the central portion of the pressure chamber 5A to inflate only a central portion of the elastic membrane 4. Thus, the central portion of the lower surface of the semiconductor wafer W is brought into contact with the polishing surface 101*a* of the polishing pad 101 and is pressed against the polishing surface 101*a* of the polishing pad 101. Then, after a lapse of short time, for example, within 1 to 3 seconds after the controller 33 opens the opening and closing valve V1, the controller 33 opens the opening and closing valve V3, and supplies the pressurized fluid from the passage (supply hole) 13 to the outer circumferential portion of the pressure chamber 5A to inflate the outer circumferential portion of the elastic membrane 4. Thus, the outer circumferential portion of the lower surface of the semiconductor wafer W is pressed against the polishing surface 101*a* of the polishing pad 101. In this manner, by bringing the central portion of the semiconductor wafer W into contact with the polishing surface first and pressing the central portion of the semiconductor wafer W against the polishing surface, as shown in FIG. 5B, air or slurry is not trapped between the polishing surface 101*a* of the polishing pad 101 and the semiconductor wafer W, and hence the semiconductor wafer W is not likely to cause larger deformation than normal, even if polishing pressure is applied as it is. Accordingly, cracking or damage of the semiconductor wafer W caused by larger deformation than normal at the time of starting polishing of the semiconductor wafer after the semiconductor wafer W is brought into contact with the polishing surface 101*a* can be prevented substantially.

Figure 6:
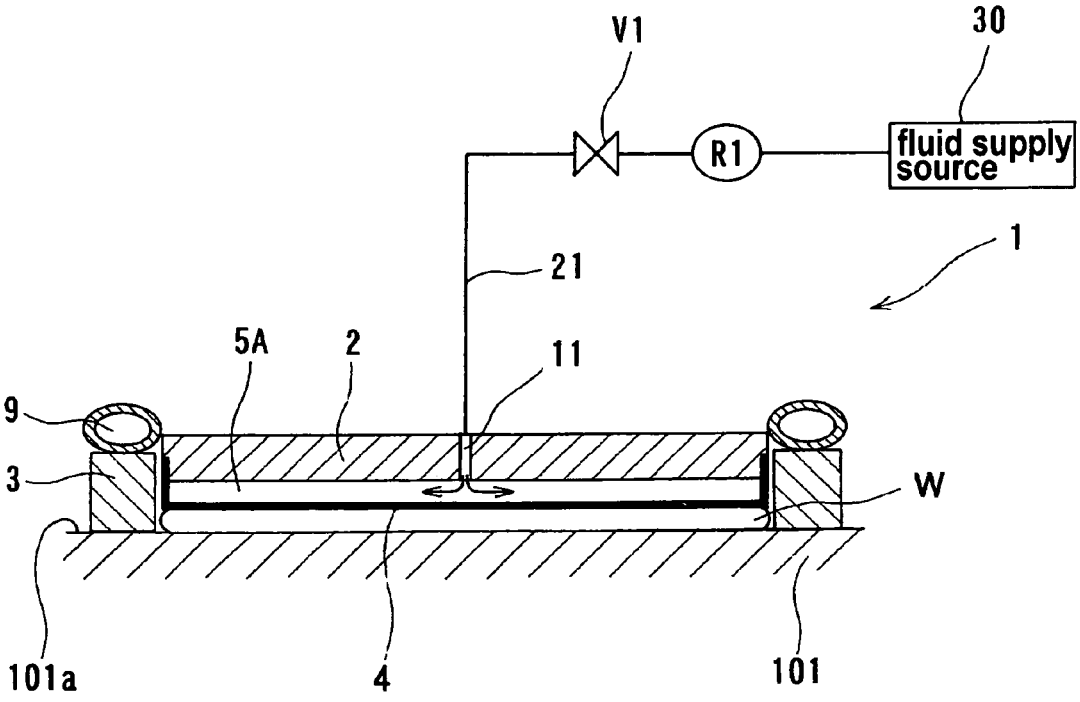
FIG. 6 is a schematic cross-sectional view showing another modified embodiment of a top ring constituting a polishing head for holding a semiconductor wafer as an object to be polished and pressing the semiconductor wafer against a polishing surface on a polishing table.

FIG. 6 is a schematic cross-sectional view showing another modified embodiment of a top ring 1 constituting a polishing head for holding a semiconductor wafer W as an object to be polished and pressing the semiconductor wafer W against a polishing surface on a polishing table.

In the embodiment shown in FIG. 6, a single pressure chamber 5A is formed between the upper surface of the elastic membrane 4 and the lower surface of the top ring body 2. In this embodiment, a passage (supply hole) 11 is formed only in the central portion of the top ring body 2. The passage (supply hole) 11 is connected via a passage 21 to a fluid supply source 30, and an opening and closing valve V1 and a pressure regulator R1 are provided in the passage 21.

In the embodiment shown in FIG. 6, when the elastic membrane 4 is inflated, the controller (not shown) opens the opening and closing valve V1, and supplies a pressurized fluid from the passage (supply hole) 11 to the central portion of the pressure chamber 5A. Thus, the central portion of the elastic membrane 4 is first inflated to bring the central portion of the lower surface of the semiconductor wafer W into contact with the polishing surface 101*a* first. Then, the pressurized fluid flows toward the outer circumferential portion of the elastic membrane 4, and after a lapse of short time, the outer circumferential portion of the semiconductor wafer W is brought into contact with the polishing surface 101*a*. In this manner, by bringing the central portion of the semiconductor wafer W into contact with the polishing surface first and pressing the central portion of the semiconductor wafer against the polishing surface, as shown in FIG. 6, air or slurry is not trapped between the polishing surface 101*a* of the polishing pad 101 and the semiconductor wafer W, and hence the semiconductor wafer W is not likely to cause larger deformation than normal, even if polishing pressure is applied as it is. Accordingly, cracking or damage of the semiconductor wafer W caused by larger deformation than normal at the time of starting polishing of the semiconductor wafer after the semiconductor wafer W is brought into contact with the polishing surface 101*a* can be prevented substantially.

In the embodiments shown in FIGS. 2 through 6, the pressure regulators R1-R5 and the opening and closing valves V1-V5 are separately provided. However, if the pressure regulators R1-R5 are arranged to have a function of an opening and closing valve for adjusting a pressure value in the range of zero to a desired value, then the opening and closing valves may be eliminated.

Figure 7:
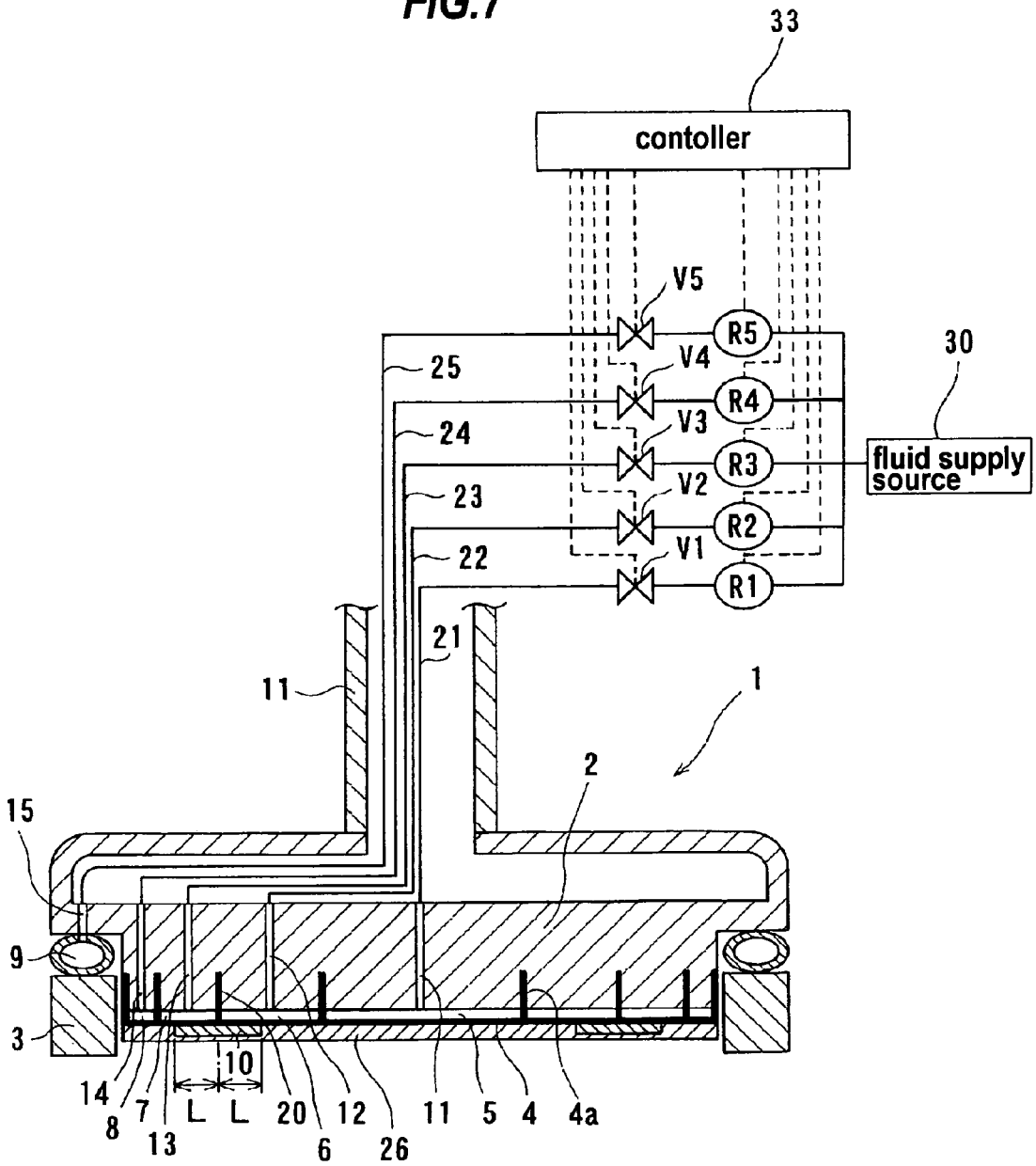
FIG. 7 is a schematic cross-sectional view showing a top ring constituting a polishing head for holding a semiconductor wafer as an object to be polished and pressing the semiconductor wafer against a polishing surface on a polishing table according to a second aspect of the present invention.

Next, a polishing head of a polishing apparatus according to a second aspect of the present invention will be described below with reference to FIG. 7. FIG. 7 is a schematic cross-sectional view showing a top ring 1 constituting a polishing head for holding a semiconductor wafer W as an object to be polished and pressing the semiconductor wafer W against a polishing surface on a polishing table. The top ring 1 shown in FIG. 7 comprises a top ring body 2, a retainer ring 3, and an elastic membrane 4 attached to the lower surface of the top ring body 2 in the same manner as the top ring 1 shown in FIG. 2. The elastic membrane 4 has a plurality of concentric partition walls 4*a*, and a circular central chamber 5, an annular ripple chamber 6, an annular outer chamber 7 and an annular edge chamber 8 are defined by the partition walls 4*a* between the upper surface of the elastic membrane 4 and the lower surface of the top ring body 2. Specifically, the central chamber 5 is defined at the central portion of the top ring body 2, and the ripple chamber 6, the outer chamber 7 and the edge chamber 8 are concentrically defined in the order from the central portion to the peripheral portion of the top ring body 2. A passage 11 communicating with the central chamber 5, a passage 12 communicating with the ripple chamber 6, a passage 13 communicating with the outer chamber 7 and a passage 14 communicating with the edge chamber 8 are formed in the top ring body 2. The respective passages 11, 12, 13 and 14 are connected via respective passages 21, 22, 23 and 24 to the fluid supply source 30. Further, opening and closing valves V1, V2, V3 and V4 and pressure regulators R1, R2, R3 and R4 are provided in the respective passages 21, 22, 23 and 24.

Further, a retainer chamber 9 is formed immediately above the retainer ring 3, and the retainer chamber 9 is connected via a passage 15 formed in the top ring body 2 and a passage 25 comprising a tube, a connector and the like to the fluid supply source 30. An opening and closing valve V5 and a pressure regulator R5 are provided in the passage 25. The pressure regulators R1, R2, R3, R4 and R5 have a pressure adjusting function for adjusting pressures of the pressurized fluid supplied from the fluid supply source 30 to the central chamber 5, the ripple chamber 6, the outer chamber 7, the edge chamber 8 and the retainer chamber 9, respectively. The pressure regulators R1, R2, R3, R4 and R5 and the opening and closing valves V1, V2, V3, V4 and V5 are connected to a controller 33, and operation of the pressure regulators R1, R2, R3, R4 and R5 and the opening and closing valves V1, V2, V3, V4 and V5 is controlled by the controller 33.

In the top ring 1 shown in FIG. 7, an annular diaphragm 10 is fixed by adhesive or the like to the lower surface of the elastic membrane 4 (at the side of wafer holding surface) over a predetermined area from a boundary 20 between the ripple chamber 6 and the outer chamber 7 both to the inner circumferential side and to the outer circumferential side of the elastic membrane 4. The diaphragm 10 comprises a thin plate having a thickness of 10 mm or less, preferably a thickness of about 0.5 mm to about 2 mm, and is composed of one of resin such as polyether ether ketone (PEEK), polyphenylene sulfide (PPS) and polyimide, metal such as stainless steel and aluminium, and ceramics such as alumina, zirconia, silicon carbide and silicon nitride. Specifically, the diaphragm 10 is composed of a material having higher rigidity than the elastic membrane 4, and covers the elastic membrane 4 over the area of not less than L=10 mm from the boundary 20 between the ripple chamber 6 and the outer chamber 7 both to the inner circumferential side and to the outer circumferential side of the elastic membrane 4.

With this arrangement, a pressure-receiving area can be ensured so that the pressure in the ripple chamber 6 and the pressure in the outer chamber 7 are sufficiently applied to the diaphragm 10. More specifically, the diaphragm 10 has a sufficient pressure-receiving area so that pressures of the pressurized fluid supplied to the two adjacent areas can be applied to the diaphragm 10. The rigidity is defined as deformation resistance of material to external force and is also referred to as stiffness. The material having higher rigidity than the elastic membrane 4 is defined as a material having less elastic deformation than the elastic membrane 4, and as a material having larger modulus of longitudinal elasticity than the elastic membrane 4.

The modulus of longitudinal elasticity of rubber material for use in the elastic membrane 4 is generally in the range of 1 to 10 MPa, whereas the modulus of longitudinal elasticity of the diaphragm 10 is preferably 1 GPa or more.

The diaphragm 10 is covered with an elastic membrane 26 so that the lower surface (wafer holding surface) of the diaphragm 10 is not brought into contact with the semiconductor wafer W directly. The elastic membrane 26 covers the lower surface of the diaphragm 10 and the entire lower surface of the elastic membrane 4. The contact surfaces of the elastic membrane 26 and the diaphragm 10 are fixed to each other by adhesive or the like, and the contact surfaces of the elastic membrane 26 and the elastic membrane 4 are fixed to each other by adhesive or the like. Because the lower surface of the elastic membrane 26 constitutes a holding surface for holding the semiconductor wafer W, the elastic membrane 26 is thin at the area where the diaphragm 10 exists and is thick at the area where the diaphragm 10 does not exist so that the entire lower surface of the elastic membrane 26 is on the same level. The elastic membrane 26 is made of a highly strong and durable rubber material such as ethylene propylene rubber (EPDM), polyurethane rubber, silicone rubber, or the like.

Next, operation of the top ring 1 having the diaphragm 10 as shown in FIG. 7 will be described with reference to FIGS. 8A and 8B.

Figure 8B:
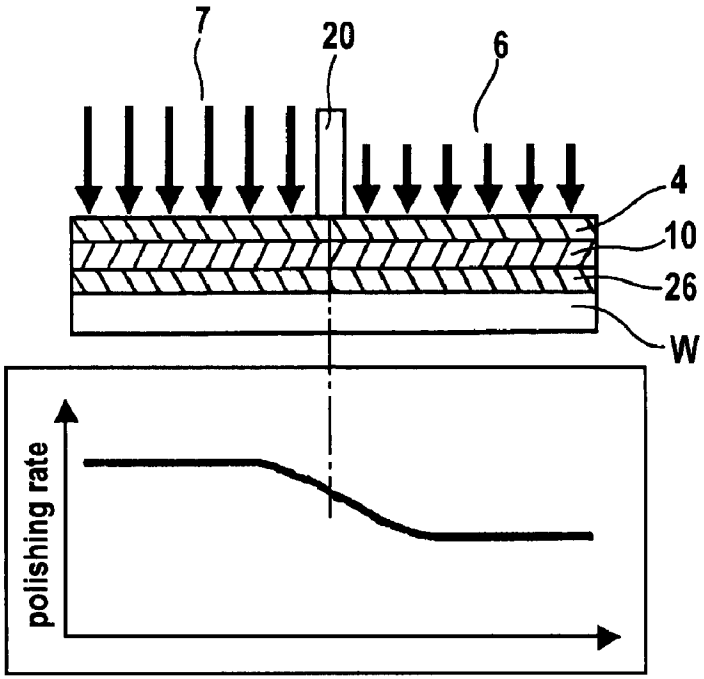
FIG. 8B is a schematic view showing operation of the top ring having a diaphragm.
Figure 8A:
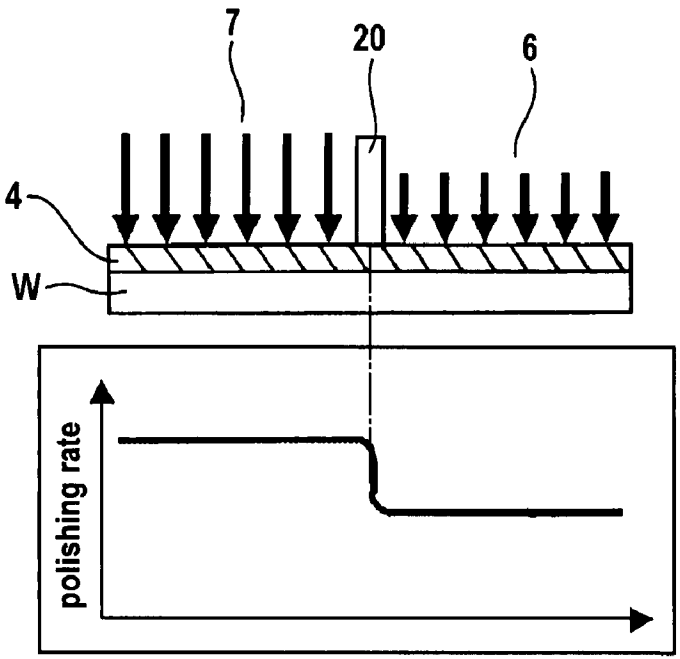
FIG. 8A is a schematic view showing operation of the top ring having no diaphragm.

FIG. 8A is a schematic view showing operation of the top ring 1 having no diaphragm 10. As shown in FIG. 8A, there is a pressure difference between the pressure in the ripple chamber 6 and the pressure in the outer chamber 7 (the pressure in the outer chamber 7>the pressure in the ripple chamber 6) at the boundary 20. As a result, as shown in the lower part of FIG. 8A, a step-like difference in polishing pressure, and hence in polishing rate is produced at the boundary 20 between the two adjacent areas.

FIG. 8B is a schematic view showing operation of the top ring 1 having the diaphragm 10. As shown in FIG. 8B, there is a pressure difference between the pressure in the ripple chamber 6 and the pressure in the outer chamber 7 (the pressure in the outer chamber 7>the pressure in the ripple chamber 6) at the boundary 20. However, as shown in the lower part of FIG. 8B, the polishing pressure, and hence the polishing rate at the boundary 20 between the two adjacent areas is lowered gradually from the side of the outer chamber 7 to the side of the ripple chamber 6. Specifically, by providing the diaphragm 10, the gradient of the polishing pressure (polishing rate) can be gentle at the boundary 20 between the two adjacent areas.

Figure 9A:
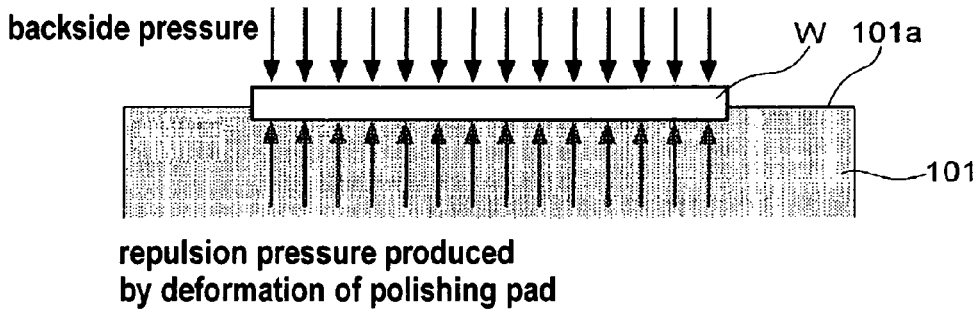
FIGS. 9A and 9B are views showing distribution condition of pressure and deformation condition of a semiconductor wafer when there is no diaphragm.
Figure 9B:
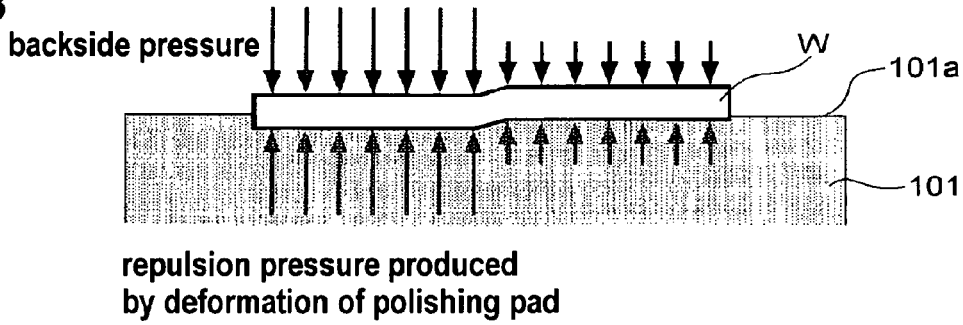
Figure 9C:
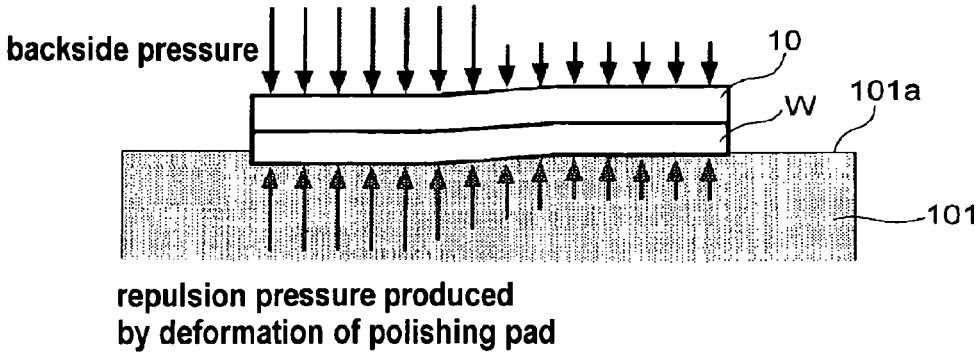
FIG. 9C is a view showing distribution condition of pressure and deformation condition of a semiconductor wafer when there is a diaphragm.

Next, the reason why by providing the diaphragm 10, the gradient of the polishing pressure (polishing rate) can be gentle at the boundary 20 between the two adjacent areas will be described with reference to FIGS. 9A, 9B and 9C. FIGS. 9A and 9B show distribution condition of pressure and deformation condition of the semiconductor wafer W when there is no diaphragm 10, and FIG. 9C shows distribution condition of pressure and deformation condition of the semiconductor wafer W when there is diaphragm 10. In all cases shown in FIGS. 9A to 9C, the polishing pressure from the backside of the semiconductor wafer W and the repulsion pressure produced by deformation of the polishing pad 101 caused by the polishing pressure balance.

(1) In the Case of Uniform Pressure

As shown in FIG. 9A, when uniform pressure (backside pressure) is applied to the semiconductor wafer W, the repulsion pressure produced by deformation of the polishing pad 101 becomes uniform.

(2) In the Case Where There is Pressure Distribution

As shown in FIG. 9B, in the case where there is distribution of pressure applied to the semiconductor wafer W, the deformation quantity of the polishing pad 101 is small at the location where the backside pressure is low, and the deformation quantity of the polishing pad 101 is large at the location where the backside pressure is high. When the rigidity of the semiconductor wafer W is low, the semiconductor wafer W is easily deformed, and thus the deformation of the semiconductor wafer W occurs locally and the deformation quantity of the polishing pad 101 varies at a narrow area of the polishing pad 101. Therefore, the distribution of polishing pressure varies sharply at the pressure boundary and its neighborhood.

(3) In the Case Where There is Pressure Distribution and There is Diaphragm 10

The backside pressure in the case (3) is the same as that in the case (2). In the case (3), the backside pressure and the repulsion pressure produced by deformation of the polishing pad 101 balance in the same manner as the case (2). The distribution of polishing pressure applied to the surface of the semiconductor wafer W in the case (3) is different from that in the case (2), but the repulsion pressure as an integrated value in the case (3) is the same as the repulsion pressure in the case (2). The polishing pressure at the location away from the pressure boundary becomes the same polishing pressure as the case (2). Thus, the deformation quantity of the polishing pad 101 becomes the same deformation quantity as the case (2). The presence of the diaphragm 10 at the upper surface of the semiconductor wafer W has the effect as if the rigidity of the semiconductor wafer W increases. Thus, the deformation quantity of the semiconductor wafer W at local areas becomes small, and the area which undergoes deformation is expanded.

The gradient of the deformation quantity of the polishing pad 101 at the pressure boundary and its neighborhood in the case (3) is gentler than that in the case (2). Then, the distribution of polishing pressure varies gently.

Further, the reason why the width (L) of the diaphragm 10 fixed to the elastic membrane 4 is not less than 10 mm from the boundary 20 between the two adjacent areas both to the inner circumferential side and to the outer circumferential side of the elastic membrane 4 is as follows: The width of step in distribution of polishing pressure produced in the pressure boundary and its neighborhood is normally about 10 mm, and hence the width (L) of the diaphragm 10 is preferably not less than 10 mm from the boundary 20 between the two adjacent areas both to the inner circumferential side and to the outer circumferential side of the elastic membrane 4.

In the embodiment shown in FIG. 7, the diaphragm 10 is fixed to the lower surface of the elastic membrane 4 (at the side of wafer holding surface) over not less than 10 mm from the boundary 20 between the ripple chamber 6 and the outer chamber 7 both to the inner circumferential side and to the outer circumferential side of the elastic membrane 4. However, the annular diaphragm 10 may be fixed to the lower surface of the elastic membrane 4 (at the side of wafer holding surface) over not less than 10 mm from the boundary 20 between the central chamber 5 and the ripple chamber 6 both to the inner circumferential side and to the outer circumferential side of the elastic membrane 4. Further, the annular diaphragm 10 may be fixed to the lower surface of the elastic membrane 4 (at the side of wafer holding surface) over not less than 10 mm from the boundary 20 between the outer chamber 7 and the edge chamber 8 both to the inner circumferential side and to the outer circumferential side of the elastic membrane 4. Furthermore, the diaphragm 10 may be fixed to the entire lower. surface of the elastic membrane 4. In this case, the gradient of polishing pressure (polishing rate) at all of the boundaries 20 between the two adjacent rooms, i.e. the two adjacent areas can be gentle.

Figure 10:
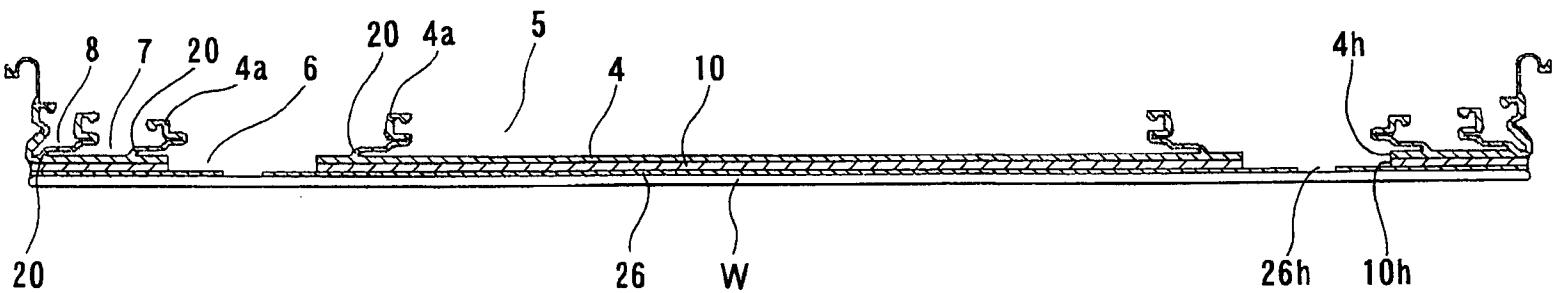
FIG. 10 is a cross-sectional view showing more concrete example of a top ring according to the second aspect of the present invention.

FIG. 10 is a cross-sectional view showing more concrete example of a top ring according to the second aspect of the present invention. In the example shown in FIG. 10, in order to show the elastic membrane 4 in detail, the top ring body 2 and the retainer ring 3 are not shown.

In the elastic membrane 4 shown in FIG. 10, because the elastic membrane 4 is required to be inflated uniformly and portions for fixing the elastic membrane 4 to the top ring body 2 are required to be formed, a plurality of concentric partition walls 4*a* for partitioning the two adjacent areas (two pressure chambers) have a complicated shape. By these partition walls 4*a*, the circular central chamber 5, the annular ripple chamber 6, the annular outer chamber 7 and the annular edge chamber 8 are formed between the upper surface of the elastic membrane 4 and the lower surface of the top ring body (not shown). Specifically, the central chamber 5 is formed at the central portion of the top ring body, and the ripple chamber 6, the outer chamber 7 and the edge chamber 8 are concentrically defined in the order from the central portion to the peripheral portion of the elastic membrane 4. In the top ring body, passages communicating with the respective pressure chambers are formed in the same manner as the embodiment shown in FIG. 7. Although not shown in FIG. 10, the central chamber 5, the ripple chamber 6, the outer chamber 7 and the edge chamber 8 are connected via the opening and closing valves V1-V5 and the pressure regulators R1-R5 to the fluid supply source 30 in the same manner as the embodiment shown in FIG. 7.

In the top ring 1 shown in FIG. 10, the diaphragm 10 is fixed to the entire lower surface of the elastic membrane 4. The diaphragm 10 is composed of one of resin such as polyether ether ketone (PEEK), polyphenylene sulfide (PPS) and polyimide, metal such as stainless steel and aluminium, and ceramics such as alumina, zirconia, silicon carbide and silicon nitride. The diaphragm 10 is covered with an elastic membrane 26 so that the lower surface (wafer holding surface) of the diaphragm 10 is not brought into contact with the semiconductor wafer W directly. The elastic membrane 26 is fixed by the adhesive or the like to the lower surface of the diaphragm 10 so that the entire lower surface of the diaphragm 10 is covered with the elastic membrane 26. Since the elastic membrane 26 constitutes a holding surface for holding the semiconductor wafer W, the elastic membrane 26 is made of a highly strong and durable rubber material such as ethylene propylene rubber (EPDM), polyurethane rubber, silicone rubber, or the like.

As shown in FIG. 10, in the case where the diaphragm 10 is provided over the entire lower surface of the elastic membrane 4, when there is a pressure difference between pressures in the two adjacent chambers, the polishing pressure, and hence the polishing rate at all of the boundaries 20 between the two adjacent areas is lowered gradually from one room side (higher pressure room side) to the other room side (lower pressure room side). Specifically, by providing the diaphragm 10, the gradient of the polishing pressure (polishing rate) can be gentle at the boundary 20 between the two adjacent areas.

In FIG. 10, a plurality of holes 26*h* formed in the elastic membrane 26 for holding the semiconductor wafer W under vacuum are shown, and a plurality of holes 10*h* formed in the diaphragm 10 for communicating with the holes 26*h* and a plurality of holes 4*h* formed in the elastic membrane 4 are shown.

Next, a top ring 1 suitable for use in the polishing apparatus according to the first and second aspects of the present invention will be described below in detail with reference to FIGS. 11 through 15. FIGS. 11 through 15 are cross-sectional views showing an example of the top ring 1 along a plurality of radial directions of the top ring 1.

Figure 11:
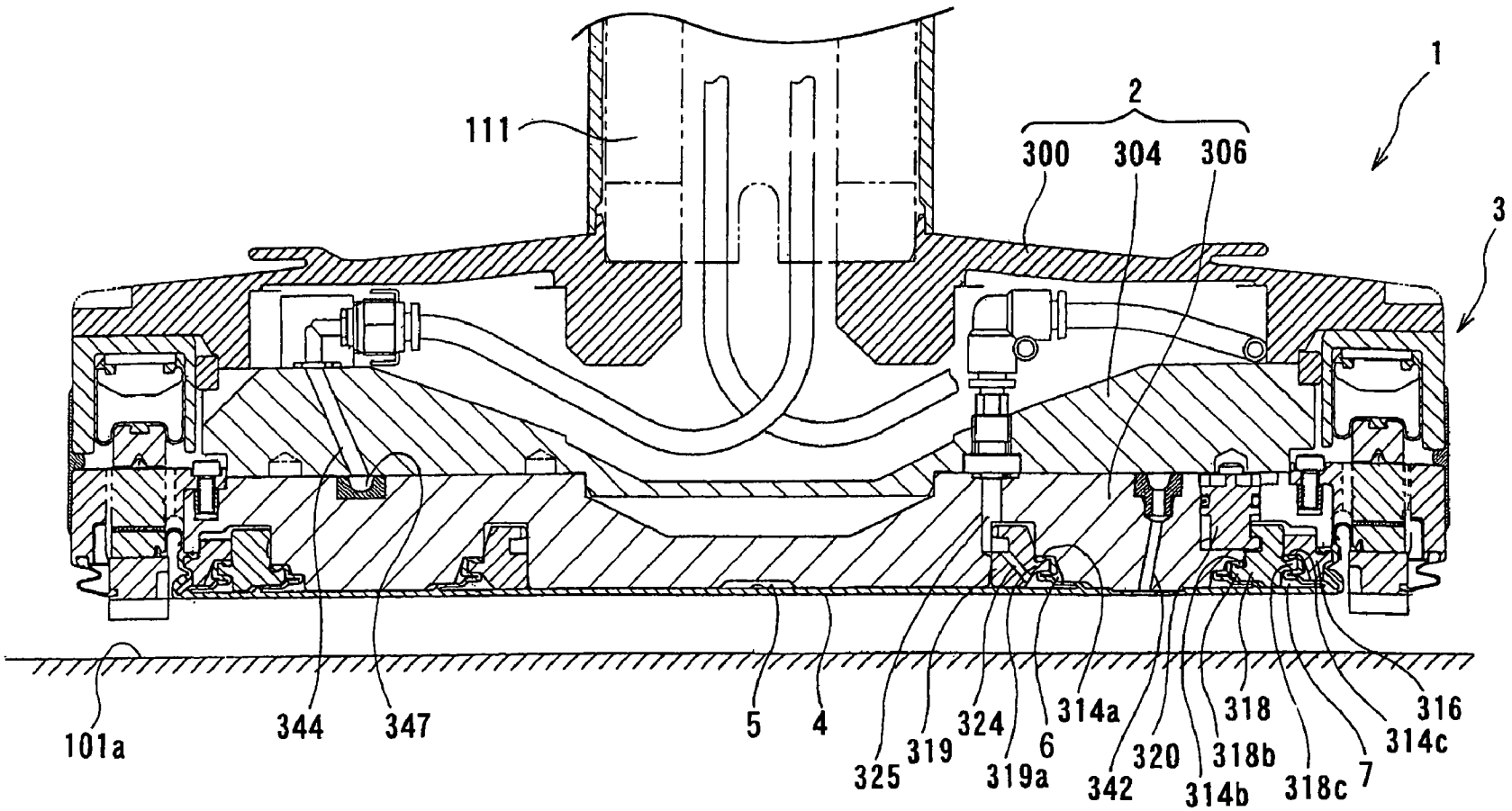
FIG. 11 is a cross-sectional view showing a structural example of a top ring suitable for use in the first and second aspects of the present invention.
Figure 12:
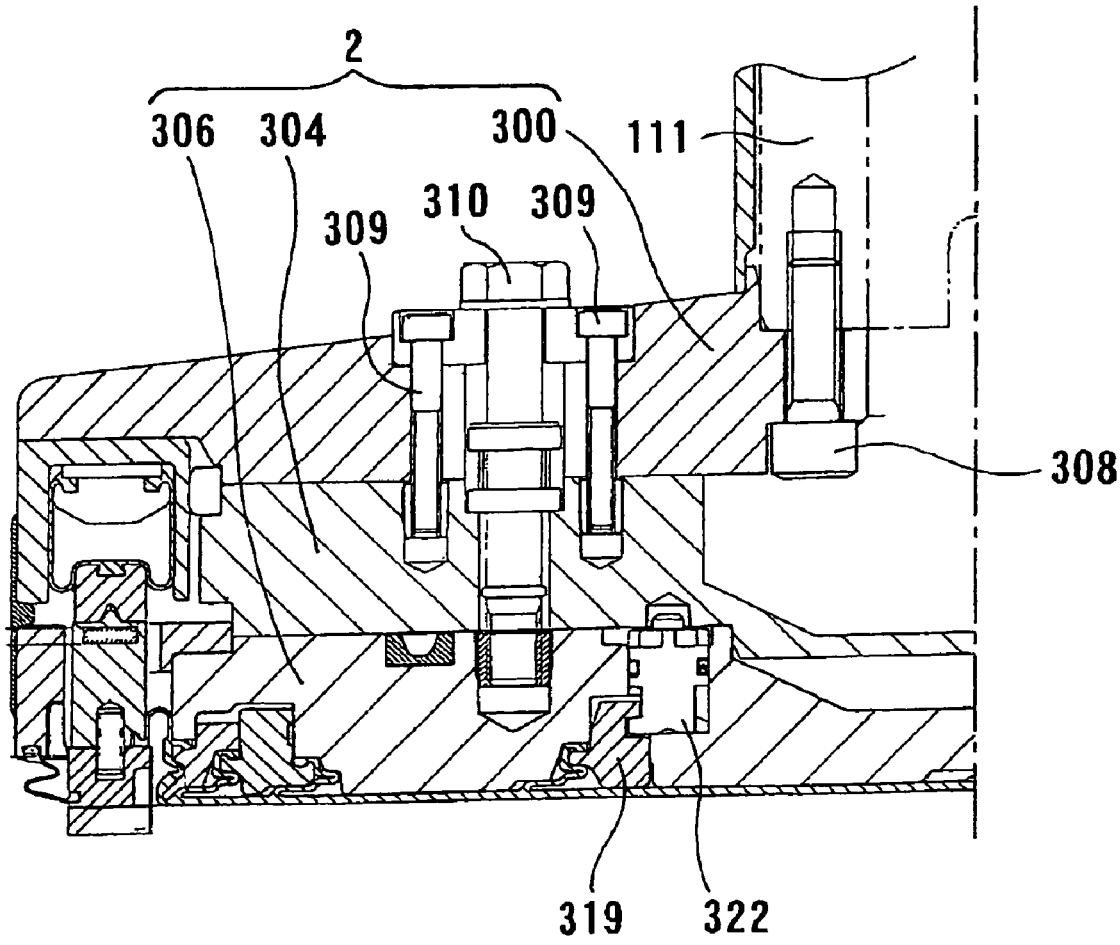
FIG. 12 is a cross-sectional view showing a structural example of a top ring suitable for use in the first and second aspects of the present invention.

As shown in FIGS. 11 through 15, the top ring 1 basically comprises a top ring body 2 for pressing a semiconductor wafer W against the polishing surface 101*a*, and a retainer ring 3 for directly pressing the polishing surface 101*a*. The top ring body 2 includes an upper member 300 in the form of a circular plate, an intermediate member 304 attached to a lower surface of the upper member 300, and a lower member 306 attached to a lower surface of the intermediate member 304. The retainer ring 3 is attached to a peripheral portion of the upper member 300. As shown in FIG. 12, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 2 comprising the upper member 300, the intermediate member 304, and the lower member 306 is made of resin such as engineering plastics (e.g., PEEK).

As shown in FIG. 11, the top ring 1 has an elastic membrane 4 attached to a lower surface of the lower member 306. The elastic membrane 4 is brought into contact with a rear face of a semiconductor wafer held by the top ring 1. The elastic membrane 4 is held on the lower surface of the lower member 306 by an annular edge holder 316 disposed radially outward and annular ripple holders 318 and 319 disposed radially inward of the edge holder 316. The elastic membrane 4 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 12, the ripple holder 319 is held on the lower surface of the lower member 306 by a plurality of stoppers 322. The stoppers 320 and the stoppers 322 are arranged along a circumferential direction of the top ring 1 at equal intervals.

As shown in FIG. 11, a central chamber 5 is formed at a central portion of the elastic membrane 4. The ripple holder 319 has a passage 324 communicating with the central chamber 5. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 5 formed by the elastic membrane 4.

The ripple holder 318 has claws 318*b* and 318*c* for pressing a ripple 314*b* and an edge 314*c* of the elastic membrane 4 against the lower surface of the lower member 306. The ripple holder 319 has a claw 319*a* for pressing a ripple 314*a* of the elastic membrane 4 against the lower surface of the lower member 306.

Figure 13:
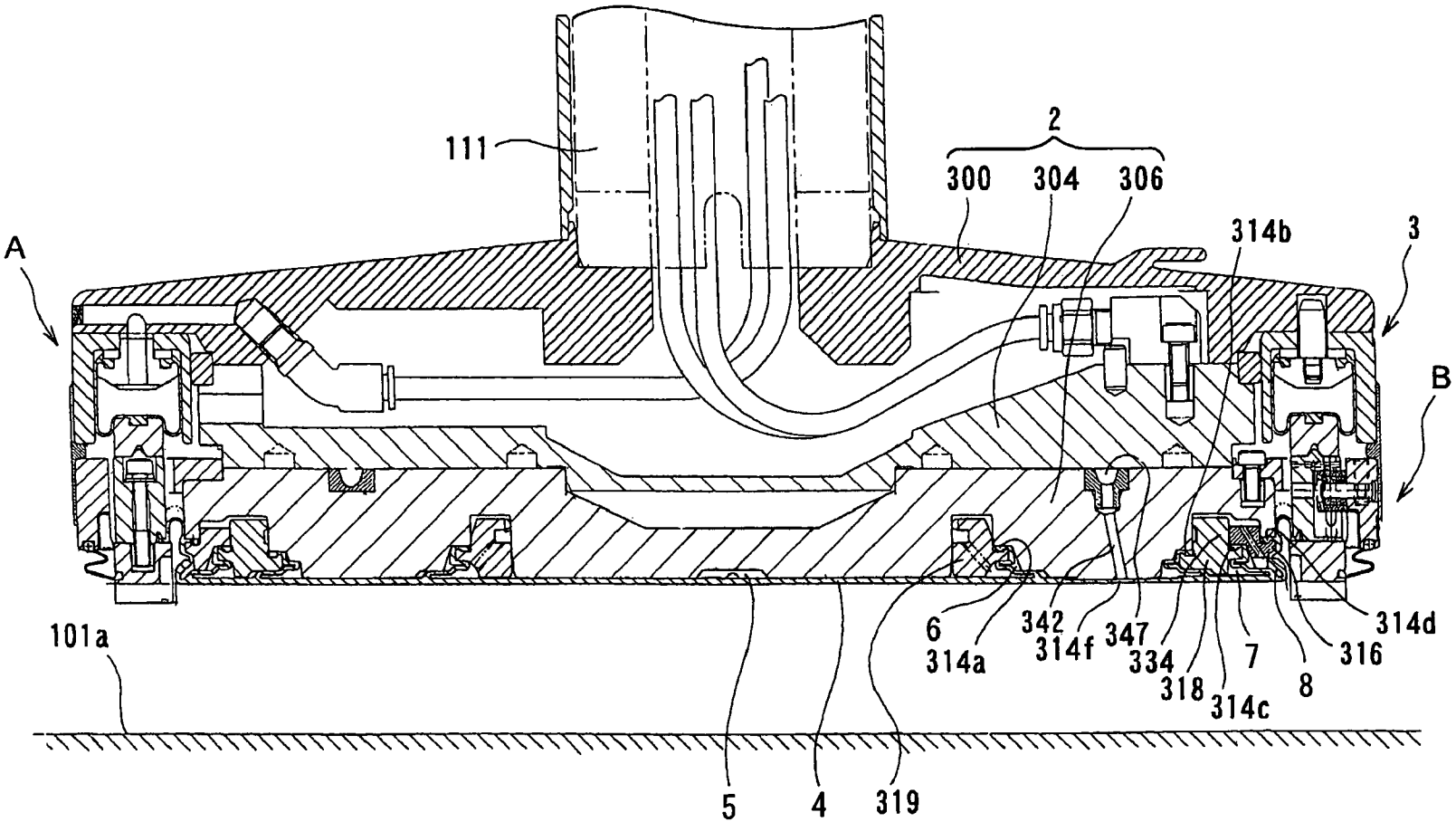
FIG. 13 is a cross-sectional view showing a structural example of a top ring suitable for use in the first and second aspects of the present invention.

As shown in FIG. 13, an annular ripple chamber 6 is formed between the ripple 314*a* and the ripple 314*b* of the elastic membrane 4. A gap 314*f* is formed between the ripple holder 318 and the ripple holder 319 of the elastic membrane 4. The lower member 306 has a passage 342 communicating with the gap 314*f*. Further, as shown in FIG. 11, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through these passages to the ripple chamber 6. Further, the passage 342 is selectively connected to a vacuum pump (not shown). When the vacuum pump is operated, a semiconductor wafer is attracted to the lower surface of the elastic membrane 4 by suction, thereby chucking the semiconductor wafer.

Figure 14:
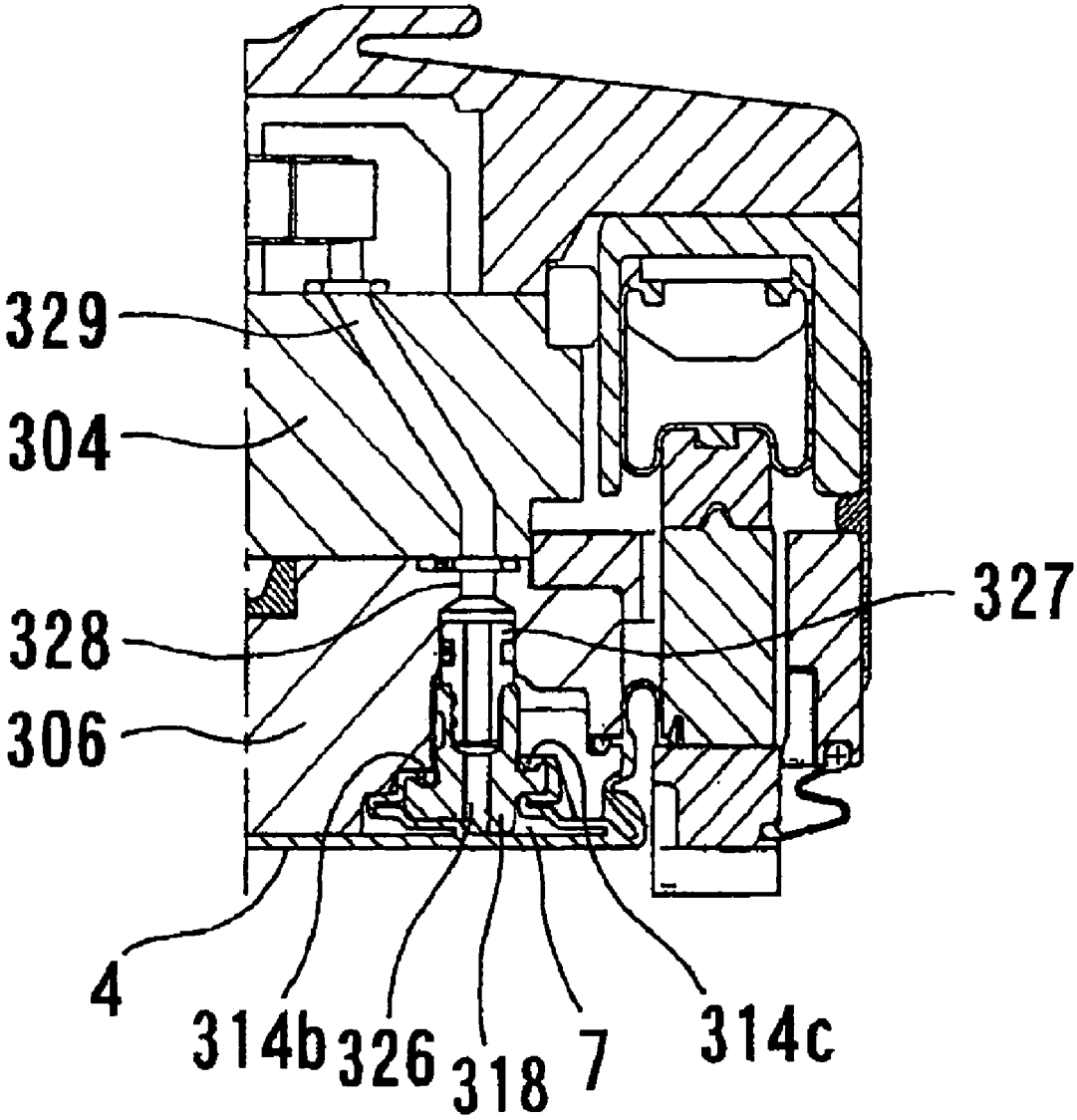
FIG. 14 is a cross-sectional view showing a structural example of a top ring suitable for use in the first and second aspects of the present invention.

As shown in FIG. 14, the ripple holder 318 has a passage 326 communicating with an annular outer chamber 7 formed by the ripple 314*b* and the edge 314*c* of the elastic membrane 4. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown) Thus, a pressurized fluid is supplied through these passages to the outer chamber 7 formed by the elastic membrane 4.

Figure 15:
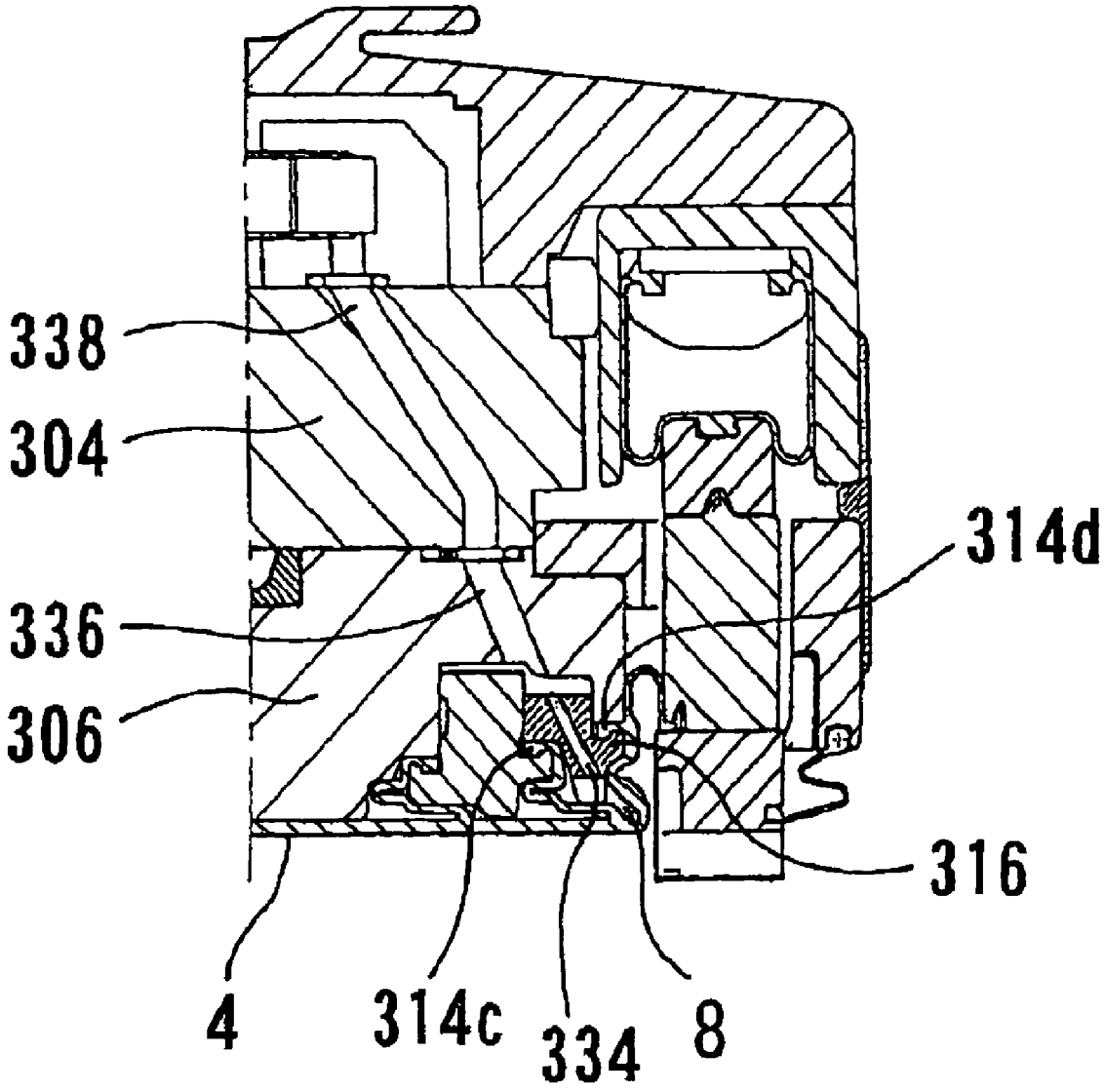
FIG. 15 is a cross-sectional view showing a structural example of a top ring suitable for use in the first and second aspects of the present invention.

As shown in FIG. 15, the edge holder 316 has a claw for holding an edge 314*d* of the elastic membrane 4 on the lower surface of the lower member 306. The edge holder 316 has a passage 334 communicating with an annular edge chamber 8 formed by the edges 314*c* and 314*d* of the elastic membrane 4. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source (not shown). Thus, a pressurized fluid is supplied through these passages to the edge chamber 8 formed by the elastic membrane 4. The central chamber 5, the ripple chamber 6, the outer chamber 7, the edge chamber 8 and the retainer chamber 9 are connected via the pressure regulators R1-R5 (not shown) and the opening and closing valves V1-V5 (not shown) to the fluid supply source in the same manner as the embodiment shown in FIG. 7.

As described above, in the top ring 1 according to the present embodiment, pressing forces for pressing a semiconductor wafer against the polishing pad 101 can be adjusted at local areas of the semiconductor wafer by adjusting pressures of fluid to be supplied to the respective pressure chambers formed between the elastic membrane 4 and the lower member 306 (i.e., the central chamber 5, the ripple chamber 6, the outer chamber 7, and the edge chamber 8).

Figure 16:
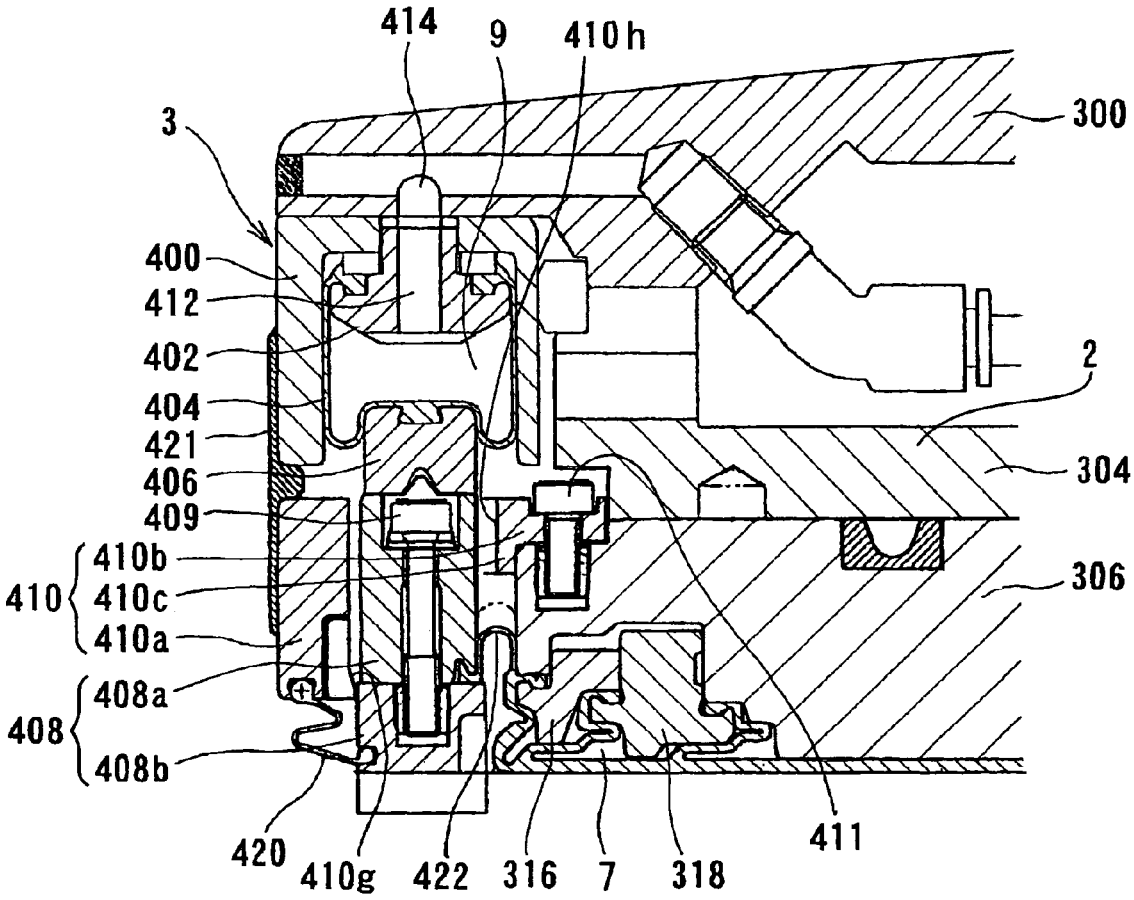
FIG. 16 is an enlarged view of A part of a retainer ring shown in FIG. 13.

FIG. 16 is an enlarged view of the retainer ring 3 shown in FIG. 13. The retainer ring 3 serves to hold a peripheral edge of a semiconductor wafer. As shown in FIG. 16, the retainer ring 3 comprises a cylinder 400 having a cylindrical shape with a closed upper end, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 101. The upper ring member 408*a* and the lower ring member

408*b* are coupled by a plurality of bolts 409. The upper ring member 408*a* is composed of a metal material such as SUS or a material such as ceramics, and the lower ring member 408*b* is made of a resin material such as PEEK or PPS.

As shown in FIG. 16, the holder 402 has a passage 412 communicating with the retainer chamber 9 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through the passages 414 and 412 to the retainer chamber 9. Accordingly, by adjusting a pressure of the fluid to be supplied to the retainer chamber 9, the elastic membrane 404 can be expanded and contracted so as to vertically move the piston 406. Thus, the ring member 408 of the retainer ring 3 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, only the ring member 408 of the retainer ring 3 can be lowered. Accordingly, a constant distance can be maintained between the lower member 306 and the polishing pad 101 even if the ring member 408 of the retainer ring 3 is worn out. Further, since the ring member 408, which is brought into contact with the polishing pad 101, and the cylinder 400 are connected by the deformable elastic membrane 404, no bending moment is produced by offset loads. Thus, surface pressures by the retainer ring 3 can be made uniform, and the retainer ring 3 becomes more likely to follow the polishing pad 101.

Further, as shown in FIG. 16, the retainer ring 3 has a ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 of the top ring 1 by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*.

Figure 17:
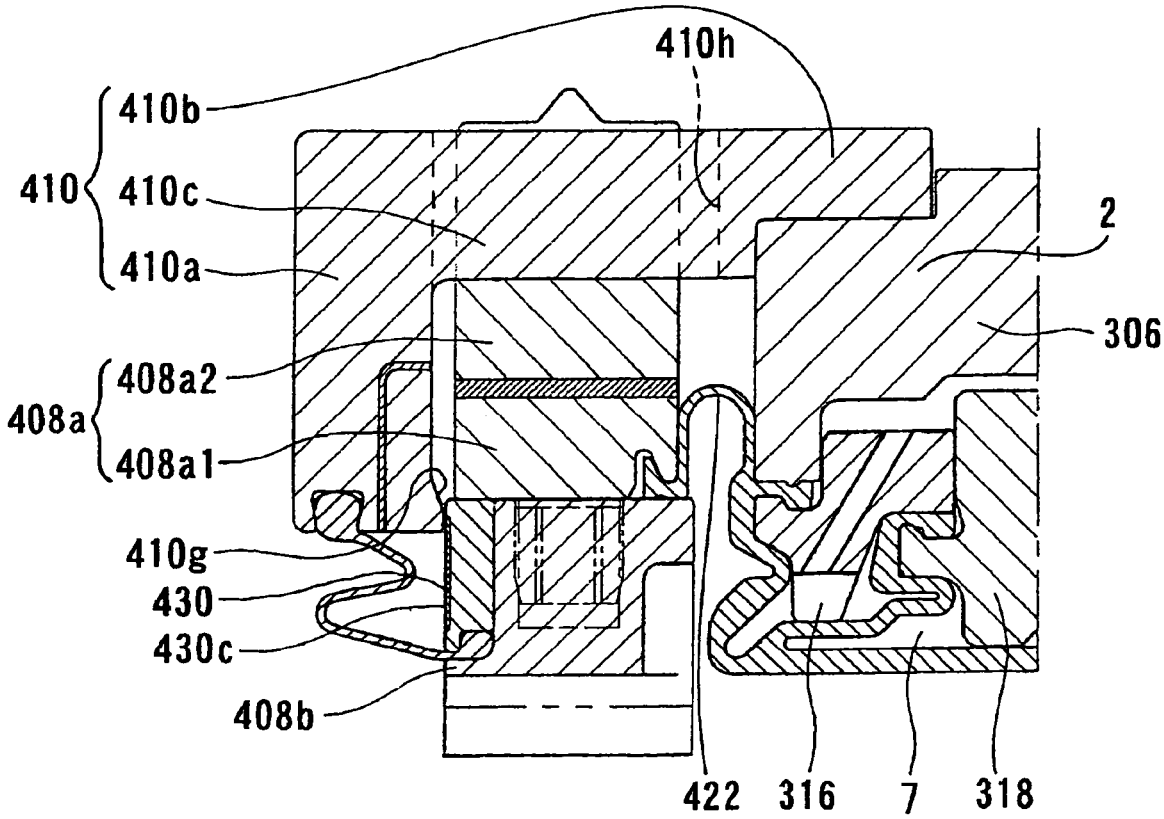
FIG. 17 is a view showing the configuration of a retainer ring guide and a ring member.

FIG. 17 shows the configuration of the retainer ring guide 410 and the ring member 408. As shown in FIG. 17, the intermediate portion 410*c* is in the form of a ring as an entirely circumferentially continuous element, and has a plurality of circular arc openings 410*h* formed at equal intervals in a circumferential direction of the intermediate portion 410*c*. In FIG. 17, the circular arc opening 410*h* is shown by dotted lines.

On the other hand, the upper ring 408*a* of the ring member 408 comprises a lower ring portion 408*a*1 in the form of a ring as an entirely circumferentially continuous element, and a plurality of upper circular arc portions 408*a*2 projecting upwardly at equal intervals in a circumferential direction from the lower ring portion 408*a*1. Each of the upper circular arc portions 408*a*2 passes through the circular arc opening 410*h* and is coupled to the piston 406 (see FIG. 16).

As shown in FIG. 17, a thin metal ring 430 made of SUS or the like is fitted over the lower ring member 408*b*. A coating layer 430*c* made of a resin material such as PEEK•PPS filled with a filler such as polytetrafluoroethylene (PTFE) or PTFE is formed on an outer circumferential surface of the metal ring 430. The resin material such as PTFE or PEEK•PPS comprises a low friction material having a low coefficient of friction, and has excellent sliding characteristics. The low friction material is defined as a material having a low coefficient of friction of 0.35 or less. It is desirable that the low friction material has a coefficient of friction of 0.25 or less.

On the other hand, the inner circumferential surface of the outer peripheral portion 410*a* of the retainer ring guide 410 constitutes a guide surface 410*g* which is brought into sliding contact with the coating layer 430*c*. The guide surface 410*g* has an improved surface roughness by mirror processing. The mirror processing is defined as a processing including polishing, lapping, and buffing.

As shown in FIG. 17, since the metal ring 430 made of SUS or the like is fitted over the lower ring member 408*b*, the lower ring member 408*b* has an improved rigidity. Thus, even if a temperature of the ring member 408*b* increases due to the sliding contact between the ring member 408*b* and the polishing surface 101*a*, thermal deformation of the lower ring member 408*b* can be suppressed. Therefore, a clearance between outer circumferential surfaces of the metal ring 430 and the lower ring member 408*b* and an inner circumferential surface of the outer peripheral portion 410*a* of the retainer ring guide 410 can be narrowed, and abnormal noise or vibration generated at the time of collision between the retainer ring guide 410 and the ring member 408 caused by movement of the ring member 408 in the clearance can be suppressed. Further, since the coating layer 430*c* formed on the outer circumferential surface of the metal ring 430 is composed of a low friction material, and the guide surface 410*g* of the retainer ring guide 410 has an improved surface roughness by mirror processing, the sliding characteristics between the lower ring member 408*b* and the retainer ring guide 410 can be improved. Thus, the following capability of the ring member 408 with respect to the polishing surface can be remarkably enhanced, and a desired surface pressure of the retainer ring can be applied to the polishing surface.

In the embodiment shown in FIG. 17, the metal ring 430 is coated with a low friction material such as PTFE or PEEK•PPS. However, a low friction material such as PTFE or PEEK•PPS may be directly provided on the outer circumferential surface of the lower ring member 408*b* by coating or adhesive. Further, a ring-shaped low friction material may be provided on the outer circumferential surface of the lower ring member 408*b* by double-faced tape. Further, the low friction material may be provided on the retainer ring guide 410, and mirror processing may be applied to the lower ring member 408*b*.

Further, both of the sliding contact surfaces of the retainer ring guide 410 and the lower ring member 408*b* may be subjected to mirror processing to improve sliding characteristics between the lower ring member 408*b* and the retainer ring guide 410. In this manner, by applying mirror processing to both of the sliding contact surfaces of the retainer ring guide 410 and the lower ring member 408*b*, the following capability of the ring member 408 with respect to the polishing surface can be remarkably enhanced, and a desired surface pressure of the retainer ring can be applied to the polishing surface.

Figure 18:
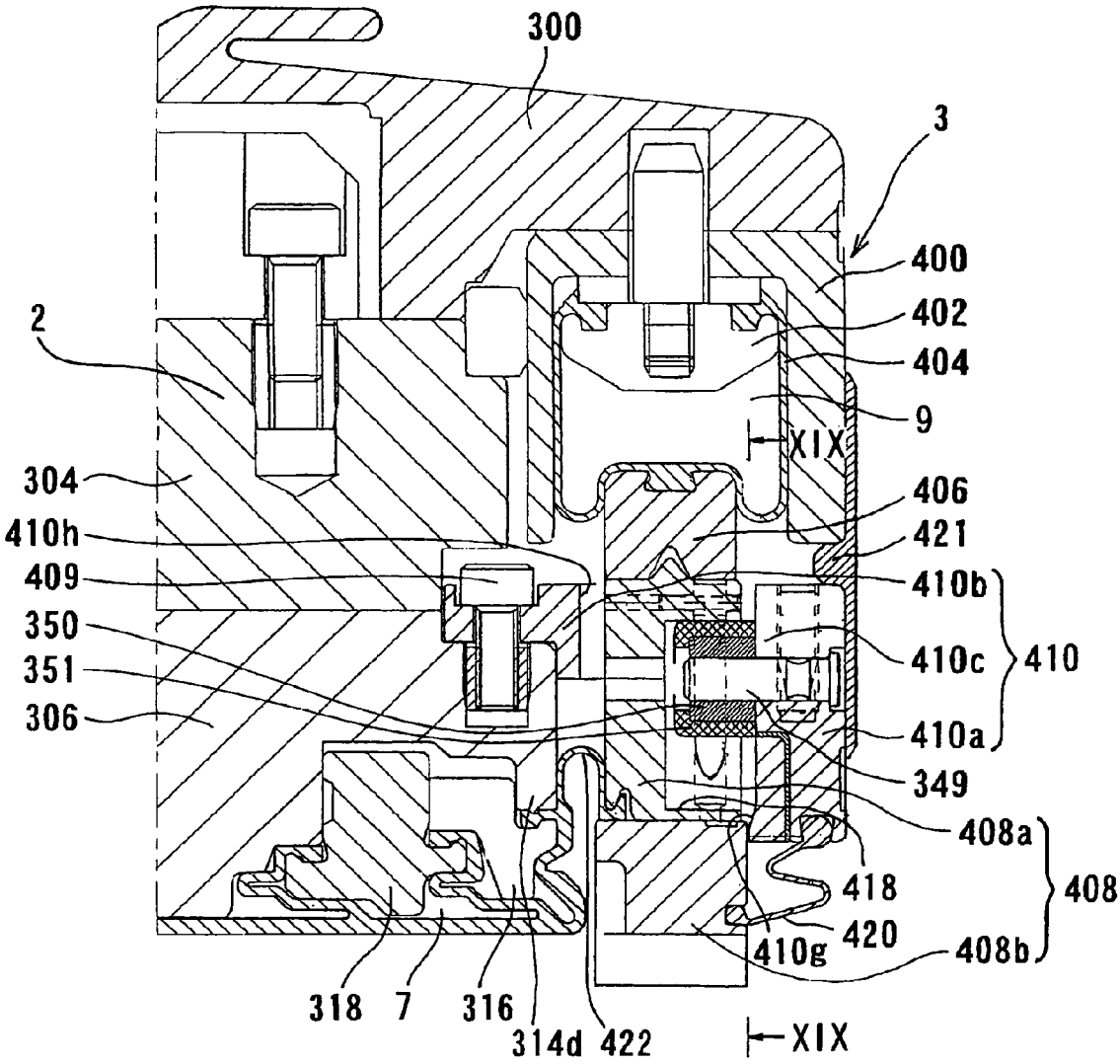
FIG. 18 is an enlarged view of B part of the retainer ring shown in FIG. 13.
Figure 19:
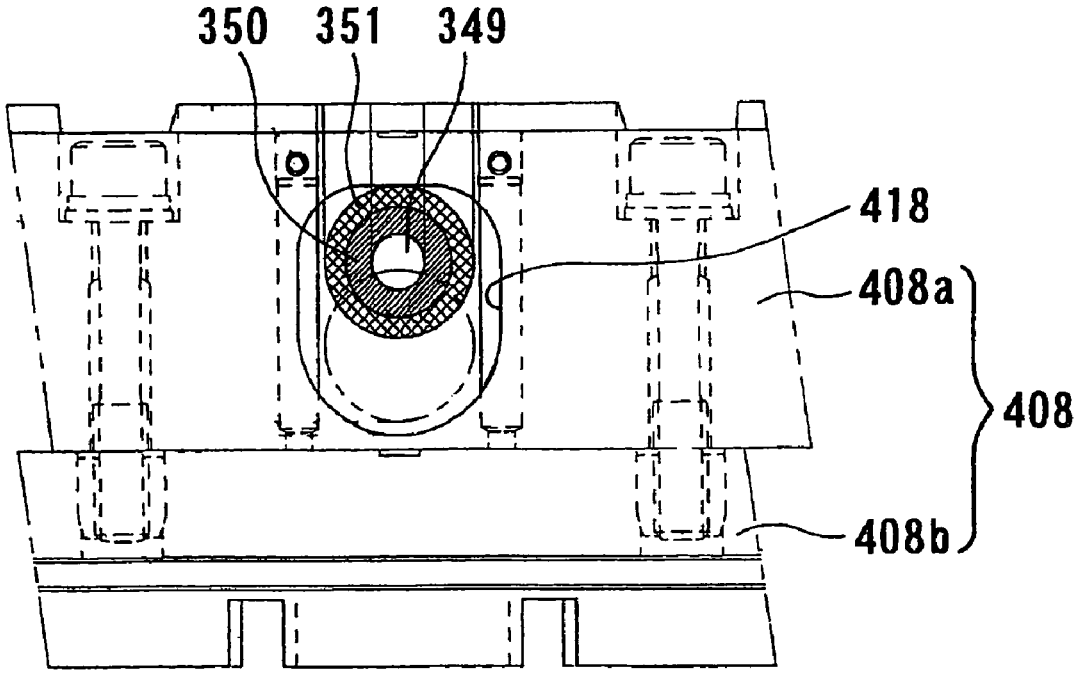
FIG. 19 is a view as viewed from line XIX-XIX of FIG. 18.

FIG. 18 is an enlarged view of B part of the retainer ring shown in FIG. 13, and FIG. 19 is a view as viewed from line XIX-XIX of FIG. 18. As shown in FIGS. 18 and 19, substantially oblong grooves 418 extending vertically are formed in the outer circumferential surface of the upper ring member 408*a* of the ring member 408 of the retainer ring 3. A plurality of oblong grooves 418 are formed at equal intervals in the outer circumferential surface of the upper ring member 408*a*. Further, a plurality of driving pins 349 projecting radially inwardly are provided on the outer peripheral portion 410*a* of the retainer ring guide 410. The driving pins 349 are configured to be engaged with the oblong grooves 418 of the ring member 408, respectively. The ring member 408 and the driving pin 349 are slidable vertically relative to each other in the oblong groove 418, and the rotation of the top ring body 2 is transmitted through the upper member 300 and the retainer ring guide 410 to the retainer ring 3 by the driving pins 349 to rotate the top ring body 2 and the retainer ring 3 integrally. A rubber cushion 350 is provided on the outer circumferential surface of the driving pin 349, and a collar 351 made of a low friction material such as PTFE or PEEK•PPS is provided on the rubber cushion 350. Further, mirror processing is applied to the inner surface of the oblong groove 418 to improve surface roughness of the inner surface of the oblong groove 418 with which the collar 351 made of a low friction material is bought into sliding contact.

In this manner, according to the present embodiment, the collar 351 made of the low friction material is provided on the driving pin 349, and mirror processing is applied to the inner surface of the oblong groove 418 with which the collar 351 is brought into sliding contact, thus enhancing the sliding characteristics between the driving pin 349 and the ring member 408. Therefore, the following capability of the ring member 408 with respect to the polishing surface can be remarkably enhanced, and a desired surface pressure of the retainer ring can be applied to the polishing surface. Mirror processing may be applied to the driving pin 349 and a low friction material may be provided on the oblong groove 418 of the ring member 408 with which the driving pin 349 is engaged.

As shown in FIGS. 11 through 18, a connection sheet 420, which can be expanded and contracted in a vertical direction, is provided between an outer circumferential surface of the ring member 408 and a lower end of the retainer ring guide 410. The connection sheet 420 is disposed so as to fill a gap between the ring member 408 and the retainer ring guide 410. Thus, the connection sheet 420 serves to prevent a polishing liquid (slurry) from being introduced into the gap between the ring member 408 and the retainer ring guide 410. A band 421 comprising a belt-like flexible member is provided between an outer circumferential surface of the cylinder 400 and an outer circumferential surface of the retainer ring guide 410. The band 421 is disposed so as to cover a gap between the cylinder 400 and the retainer ring guide 410. Thus, the band 421 serves to prevent a polishing liquid (slurry) from being introduced into the gap between the cylinder 400 and the retainer ring guide 410.

The elastic membrane 4 includes a seal portion 422 connecting the elastic membrane 4 to the retainer ring 3 at an edge (periphery) 314*d* of the elastic membrane 4. The seal portion 422 has an upwardly curved shape. The seal portion 422 is disposed so as to fill a gap between the elastic membrane 4 and the ring member 408. The seal portion 422 is made of a deformable material. The seal portion 422 serves to prevent a polishing liquid from being introduced into the gap between the elastic membrane 4 and the ring member 408 while allowing the top ring body 2 and the retainer ring 3 to be moved relative to each other. In the present embodiment, the seal portion 422 is formed integrally with the edge 314*d* of the elastic membrane 4 and has a U-shaped cross-section.

If the connection sheet 420, the band 421 and the seal portion 422 are not provided, a polishing liquid may be introduced into an interior of the top ring 1 so as to inhibit normal operation of the top ring body 2 and the retainer ring 3 of the top ring 1. In the present embodiment, the connection sheet 420, the band 421 and the seal portion 422 prevent a polishing liquid from being introduced into the interior of the top ring 1. Accordingly, it is possible to operate the top ring 1 normally. The elastic membrane 404, the connection sheet 420, and the seal portion 422 are made of a highly strong and durable rubber material such as ethylene propylene rubber (EPDM), polyurethane rubber, silicone rubber, or the like.

In the top ring 1 according to the present embodiment, pressing forces to press a semiconductor wafer against a polishing surface are controlled by pressures of fluid to be supplied to the central chamber 5, the ripple chamber 6, the outer chamber 7, and the edge chamber 8 formed by the elastic membrane 4. Accordingly, the lower member 306 should be located away upward from the polishing pad 101 during polishing. However, if the retainer ring 3 is worn out, a distance between the semiconductor wafer and the lower member 306 is varied to change a deformation manner of the elastic membrane 4. Thus, surface pressure distribution is also varied on the semiconductor wafer. Such a variation of the surface pressure distribution causes unstable profiles of polished semiconductor wafers.

In the illustrated example, since the retainer ring 3 can vertically be moved independently of the lower member 306, a constant distance can be maintained between the semiconductor wafer and the lower member 306 even if the ring member 408 of the retainer ring 3 is worn out. Accordingly, profiles of polished semiconductor wafers can be stabilized.

If the first aspect of the present invention is applied to the top ring 1 shown in FIGS. 11 through 19, the central chamber 5, the ripple chamber 6, the outer chamber 7, the edge chamber 8 and the retainer chamber 9 may be connected via the opening and closing valves V1-V5 (not shown) and the pressure regulators R1-R5 (not shown) to the fluid supply source 30 (not shown), and operation of the opening and closing valves V1-V5 and the pressure regulators R1-R5 may be controlled by the controller 33 in the same manner as the embodiment shown in FIG. 7. Then, the controller 33 opens the opening and closing valve V1 first, and supplies a pressurized fluid from the fluid supply source 30 to the central chamber 5 to inflate only the central portion of the elastic membrane 4. Thus, the central portion of the lower surface of the semiconductor wafer W is brought into contact with the polishing surface 101*a* of the polishing pad 101 and is pressed against the polishing surface 101*a* of the polishing pad 101. Then, after a lapse of short time after the controller 33 opens the opening and closing valve V1, the controller 33 opens the opening and closing valve V2, the opening and closing valve V3 and the opening and the closing valve V4 sequentially, and supplies a pressurized fluid, in the order from the central portion to the peripheral portion of the top ring body 2, to the ripple chamber 6, the outer chamber 7 and the edge chamber 8 to inflate the outer circumferential portion of the elastic membrane 4. Thus, the outer circumferential portion of the lower surface of the semiconductor wafer W is pressed against the polishing surface 101*a* of the polishing pad 101. In this manner, by bringing the central portion of the semiconductor wafer W into contact with the polishing surface first and pressing the central portion of the semiconductor wafer against the polishing surface, air or slurry is not trapped between the polishing surface 101*a* of the polishing pad 101 and the semiconductor wafer W, the semiconductor wafer W is not likely to cause larger deformation than normal, even if polishing pressure is applied as it is. Accordingly, cracking or damage of the semiconductor wafer W at the time of starting polishing of the semiconductor wafer after the semiconductor wafer W is brought into contact with the polishing surface 101*a* can be prevented.

If the second aspect of the present invention is applied to the top ring 1 shown in FIGS. 11 through 19, the diaphragm 10 may be fixed to the entire lower surface of the elastic membrane 4 and the elastic membrane 26 may be fixed to the lower surface (wafer holding surface) of the diaphragm 10 in the same manner as the embodiment shown in FIG. 10. The diaphragm 10 is composed of one of resin such as polyether ether ketone (PEEK), polyphenylene sulfide (PPS) and polyimide, metal such as stainless steel and aluminium, and ceramics such as alumina, zirconia, silicon carbide and silicon nitride. In this manner, by providing the diaphragm 10 over the entire lower surface of the elastic membrane 4, when there is a pressure difference between pressures in the two adjacent chambers, the polishing pressure, and hence the polishing rate at all of the boundaries 20 between the two adjacent areas is lowered gradually from one room side (higher pressure room side) to the other room side (lower pressure room side). Specifically, by providing the diaphragm 10, the gradient of the polishing pressure (polishing rate) can be gentle at all of the boundaries between the two adjacent areas.

The diaphragm 10 may be fixed to the lower surface of the elastic membrane 4 over not less than 10 mm from the boundary 20 between the ripple chamber 6 and the outer chamber 7 both to the inner circumferential side and to the outer circumferential side of the elastic membrane 4 in the same manner as the embodiment shown in FIG. 7. Further, the diaphragm 10 may be fixed to the lower surface of the elastic membrane 4 over not less than 10 mm from the boundary 20 between the central chamber 5 and the ripple chamber 6 both to the inner circumferential side and to the outer circumferential side of the elastic membrane 4, or from the boundary 20 between the outer chamber 7 and the edge chamber 8 both to the inner circumferential side and to the outer circumferential side of the elastic membrane 4.

Although certain preferred embodiments of the present invention have been shown and described in detail, it should be understood that various changes and modifications may be made therein without departing from the scope of the appended claims.

What is claimed is:

1. An apparatus for polishing a substrate, comprising:

a polishing table having a polishing surface;

a polishing head having at least one elastic membrane configured to form a plurality of pressure chambers for being supplied with a pressurized fluid, said elastic membrane being configured to press the substrate against said polishing surface under a fluid pressure when said pressure chambers are supplied with the pressurized fluid; and a diaphragm configured to cover at least part of said elastic membrane and extend over the two adjacent pressure chambers, said diaphragm being composed of a material having higher rigidity than said elastic membrane;

wherein said diaphragm has an area of not less than 10 mm from a boundary between said two pressure chambers both to an inner circumferential side and to an outer circumferential side of said elastic membrane.

2. The apparatus according to claim 1, wherein said diaphragm is fixed to said elastic membrane.

3. The apparatus according to claim 1, wherein said diaphragm is composed of one of resin comprising polyether ether ketone (PEEK), polyphenylene sulfide (PPS) or polyimide, metal comprising stainless steel or aluminum, and ceramics comprising alumina, zirconia, silicon carbide or silicon nitride.

4. The apparatus according to claim 3, wherein said elastic membrane is composed of ethylene propylene rubber (EPDM), polyurethane rubber, or silicone rubber.

5. The apparatus according to claim 1, wherein said diaphragm is configured to cover a substantially entire surface of said elastic membrane.

6. The apparatus according to claim 1, further comprising a second elastic membrane configured to cover said diaphragm, said second elastic membrane constituting a substrate holding surface configured to contact the substrate and hold the substrate.

7. The apparatus according to claim 6, wherein said second elastic membrane extends over said diaphragm and said elastic membrane configured to form said pressure chambers.

* * * * *